US007588308B2

(12) United States Patent
Ootsuka

(10) Patent No.: US 7,588,308 B2
(45) Date of Patent: Sep. 15, 2009

(54) LIQUID EJECTION APPARATUS AND AIR BUBBLE DETERMINATION METHOD

(75) Inventor: Hiroyuki Ootsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 528 days.

(21) Appl. No.: 11/527,694

(22) Filed: Sep. 27, 2006

(65) Prior Publication Data

US 2007/0070112 A1 Mar. 29, 2007

(30) Foreign Application Priority Data

Sep. 28, 2005 (JP) ..... 2005-282786

(51) Int. Cl.
*B41J 29/393* (2006.01)
*B41J 2/19* (2006.01)

(52) U.S. Cl. ..... 347/19; 347/92

(58) Field of Classification Search ..... 347/19, 347/54, 68, 92
See application file for complete search history.

(56) References Cited

U.S. PATENT DOCUMENTS 4,498,088 A * 2/1985 Kanayama ..... 347/92
5,500,657 A 3/1996 Yauchi et al.
6,398,329 B1 * 6/2002 Boyd et al. ..... 347/7

FOREIGN PATENT DOCUMENTS

JP 10-114074 A 5/1998

* cited by examiner

*Primary Examiner*—Anh T. N. Vo
(74) *Attorney, Agent, or Firm*—Birch, Stewart, Kolasch & Birch, LLP

(57) ABSTRACT

The liquid ejection apparatus comprises: a liquid ejection head including a nozzle which ejects liquid, a pressure chamber provided to correspond to the nozzle, a pressure generating element which is disposed on a first wall surface of the pressure chamber and adjusts pressure in the pressure chamber, and a determination element which is disposed on a second wall surface of the pressure chamber and generates a first determination signal corresponding to the pressure in the pressure chamber adjusted by the pressure generating element; a threshold value setting device which sets a threshold value in accordance with a waveform of the first determination signal generated by the determination element; a comparing device which acquires a comparison result obtained by comparing the first determination signal with the threshold value which is set by the threshold value setting device; and an evaluation device which acquires an evaluation result obtained by evaluating a size of an air bubble present in the pressure chamber according to the comparison result acquired by the comparing device.

10 Claims, 17 Drawing Sheets

LIQUID EJECTION APPARATUS AND AIR BUBBLE DETERMINATION METHOD

BACKGROUND OF THE INVENTION

1. Field of the Invention

The present invention relates to a liquid ejection apparatus and an air bubble determination method, and more particularly, to ejection determination in a liquid ejection apparatus which forms an image, or the like, on a medium by ejecting liquid from a nozzle.

2. Description of the Related Art

Inkjet recording apparatuses which comprise an inkjet head having a plurality of nozzles and record images onto a medium by ejecting ink toward the medium from the inkjet head, are known.

In an inkjet recording apparatus, if there is an increase in the viscosity of the ink or infiltration of air bubbles into the inkjet head, or if dirt, paper dust, or other foreign matter adheres to the ink ejection surface, then the nozzles may become blocked and it is difficult to eject ink droplets. If the nozzle blockages occur, then dot omissions occur in the image formed on the medium, and this causes degradation of the image quality. Some inkjet recording apparatuses are composed in such a manner that the nozzle blockages are determined and a maintenance operation is carried out in respect of the nozzles thus determined to have blockages.

An embodiment of ejection abnormality determination in nozzles relating to the related art is described with respect to FIGS. 17A to 17D. In the ejection abnormality determination according to the related art, the pressure generated in the pressure chambers is determined by means of pressure sensors provided in the pressure chambers, and ejection abnormalities in the nozzles connected to the pressure chambers are judged on the basis of the magnitude correlation between a peak value $V_p$ of the waveform of the generated pressure and a prescribed threshold value $V_{th}$.

FIG. 17A shows a sensor signal 300 obtained from a pressure sensor. As shown in FIG. 17A, the sensor signal 300 has a voltage (waveform) that is directly proportional to the pressure of the pressure chamber (pressure waveform), and a pressure abnormality in the corresponding pressure chamber is judged on the basis of the magnitude correlation between the peak value $V_p$ of the sensor signal 300 and the predetermined threshold voltage $V_{th}$.

A composition is adopted in which, if the peak value $V_p$ of the sensor signal 300 is greater than the threshold voltage $V_{th}$, then the pulse signal 302 is obtained as shown in FIG. 17B. Furthermore, if the pulse signal 302 is obtained, then it is judged that the pressure in the pressure chamber is normal and that the nozzle connected to the pressure chamber is in normal ejection state.

On the other hand, the sensor signal 304 shown in FIG. 17C has a peak value $V'_p$ that is smaller than the threshold voltage $V_{th}$, and therefore the pulse signal (represented by numerical sign "302" in FIG. 17B) is not obtained as shown in FIG. 17D. If the pulse signal is not obtained, then it is judged that the pressure abnormality has occurred in the corresponding pressure chamber, and hence it is judged that the nozzle connected to the pressure chamber is in ejection abnormality state. In other words, by setting the threshold voltage $V_{th}$ to an appropriate value, it is possible to judge that the pressure abnormality in the pressure chamber occurs and therefore the nozzle connected to the pressure chamber suffering the pressure abnormality is in the ejection abnormality state.

Furthermore, systems have also been proposed in which maintenance processing is carried out for the nozzles at a constant time interval, without determining the ejection abnormalities in the nozzles. In the system which carries out maintenance processing for the nozzles before the occurrence of the ejection abnormality in this way, it is possible to prevent the occurrence of the ejection abnormalities, in advance, by setting the time interval for maintenance processing to a suitable time.

The invention disclosed in Japanese Patent Application Publication No. 10-114074 relates to an inkjet recording head comprising electrostrictive vibrating elements provided respectively in the ink flow channels of a plurality of nozzles, which ejects ink droplets by applying a drive voltage to the electrostrictive vibrating elements. The inkjet recording head further comprises an air bubble determination device which determines the presence or absence of air bubbles in the ink flow channels by determining whether the voltage occurring in the electrostrictive vibrating elements due to the volume change in the ink flow channels becomes an excess voltage (in other words, the value of the voltage occurring in the electrostrictive vibrating elements becomes the value of the drive voltage or more) or not constantly during a printing operation.

However, in the embodiments shown in FIGS. 17A to 17D, the pressure abnormalities in the pressure chambers are judged on the basis of one constant threshold voltage. Therefore, even if there is a pressure abnormality that does not reach a sufficient level to affect ejection, it is judged on the basis of the pressure abnormality that the ejection abnormality has occurred, and hence the maintenance processing is carried out for the corresponding nozzle.

Furthermore, in a composition in which maintenance processing is carried out at a constant time interval, an expensive timer circuit is required in order to manage the interval for the maintenance processing, and since the maintenance is carried out irrespectively of the presence or absence of the ejection abnormalities, then the ink consumption increases, which is not economical.

In the invention disclosed in Japanese Patent Application Publication No. 10-114074, the presence or absence of air bubbles is determined by determining whether the voltage occurring in the electrostrictive vibrating elements becomes an excess voltage, which is the drive voltage or more. Therefore, if there is even an air bubble of a small size which is not sufficient to affect ink droplet ejection, it is judged that the ejection abnormality has occurred. Therefore, unnecessary and wasteful restoration processing is carried out, and the ink consumption increases, which is not economical.

SUMMARY OF THE INVENTION

The present invention has been contrived in view of the foregoing circumstances, an object thereof being to provide a liquid ejection apparatus and an air bubble judgment method whereby the presence or absence of an ejection abnormality can be determined by means of a simple composition and method.

In order to attain the aforementioned object, the present invention is directed to a liquid ejection apparatus, comprising: a liquid ejection head including a nozzle which ejects liquid, a pressure chamber provided to correspond to the nozzle, a pressure generating element which is disposed on a first wall surface of the pressure chamber and adjusts pressure in the pressure chamber, and a determination element which is disposed on a second wall surface of the pressure chamber and generates a first determination signal corresponding to the pressure in the pressure chamber adjusted by the pressure generating element; a threshold value setting device which sets a threshold value in accordance with a waveform of the first determination signal generated by the determination element; a comparing device which acquires a comparison result obtained by comparing the first determination signal with the threshold value which is set by the threshold value setting device; and an evaluation device which acquires an evaluation result obtained by evaluating a size of an air bubble present in the pressure chamber according to the comparison result acquired by the comparing device.

According to this aspect of the present invention, the threshold value is set on the basis of the determination signal which is obtained from the determination element and is directly proportional to the pressure in the pressure chamber, and the size of an air bubble present in the pressure chamber is evaluated from the result of comparing the threshold value with the waveform of the determination signal. Therefore, it is possible to determine the size of the air bubble occurring in the pressure chamber by means of such a simple composition, and furthermore, improved determination accuracy can be expected.

In other words, when an air bubble occurs inside the pressure chamber, the pressure loss which is directly proportional to the size of the air bubble occurs in the pressure chamber, and hence the waveform variation corresponding to the pressure loss (a voltage drop directly proportional to the pressure loss) appears in the determination signal. Therefore, by setting the threshold value in accordance with the variation in the waveform of the determination signal, the threshold value that is suitable for determining the size of the air bubble is set.

A fluorine resin-based piezoelectric element made of PVDF (polyvinylidene fluoride) or the like, is suitable for use as the pressure determination element. Furthermore, a ceramic-based piezoelectric element (piezoelectric actuator) made of PZT (lead zirconate titanate) or the like, is suitable for use as the pressure generating element. If a plurality of piezoelectric element parts are required for the pressure determination element(s) and the pressure generating element(s), then it is possible to adopt a composition in which a piezoelectric body is formed as a single member for all of the plurality of pressure chambers, and drive signal application electrodes are provided in the respective parts of the piezoelectric body corresponding to the pressure chambers, or a composition in which piezoelectric bodies are formed respectively for the pressure chambers and drive signal application electrodes are provided respectively for the piezoelectric bodies.

A configuration is also possible in which the liquid ejection apparatus comprises a signal processing device which carries out signal processing, such as amplification or noise reduction, on the determination signal obtained from the determination element.

The liquid ejection head may be a line type head including a row of ejection holes having a length corresponding to the full width of the recording medium (the width of the possible image formation region of the recording medium), or a serial head in which a short head including a row of ejection holes having a length that does not reach the full width of the recording medium is used, and this head is made to scan in the breadthways direction of the recording medium.

Such a line type of liquid ejection head may have a length corresponding to the full width of the recording medium by combining short heads having rows of ejection holes which do not reach a length corresponding to the full width of the recording medium in such a manner that the short heads are joined together in a staggered matrix fashion.

The state where pressure of prescribed pressure value in the pressure chamber is generated (adjusted) by means of the pressure generating element, includes a state where the pressure generated in the pressure chamber serves as an ejection force and consequently liquid of a prescribed volume is ejected from the nozzle. In other words, the pressure generating element may also function as an ejection force generating element that applies the ejection force to the liquid inside the pressure chamber.

The first wall surface and the second wall surface of the pressure chamber may be formed separately, or may be formed integrally. Thus, the pressure generating element and the pressure determination element may be provided on the same wall, or may be provided on the separate walls respectively.

Preferably, the liquid ejection apparatus further comprises: an air bubble removal device which carries out an air bubble removal processing with respect to the liquid ejection head; and a control device which controls the air bubble removal device according to the evaluation result acquired by the evaluation device.

According to this aspect of the present invention, the air bubble removal processing is carried out with respect to the liquid ejection head in accordance with the evaluation result of the evaluation device, and therefore desirable air bubble removal processing is carried out in accordance with the size of the air bubble present in the pressure chamber.

For example, there is a mode in which, if a (small) air bubble of a size that dose not affect liquid ejection is present in the pressure chamber, then the air bubble removal processing is not carried out. In such a mode where the air bubble removal processing is not carried out if the size of an air bubble present in the pressure chamber is small enough not to affect liquid ejection, it is possible to restrict ink consumption composition due to the air bubble removal processing. Furthermore, since it is possible to reduce the number of times for the air bubble removal processing, then the load of the air bubble removal processing is reduced.

The air bubble removal processing includes processes known as maintenance processing, such as purging and suctioning, and there is a mode in which processing such as removal of ink of increased viscosity inside a nozzle is carried out simultaneously with the removal of air bubbles inside the pressure chambers. For the air bubble removal processing, it is possible to use restoration processing which is carried out when the apparatus is initialized by switching on the power source, changing the settings, or the like.

Preferably, the control device controls the air bubble removal device in such a manner that, when the size of the air bubble present in the pressure chamber evaluated by the evaluation device is sufficient to cause an ejection abnormality, the air bubble removal processing is carried out with respect to the liquid ejection head.

According to this aspect of the present invention, since the air bubble removal processing is carried out if the air bubble that is liable to affect liquid ejection (the air bubble that is liable to lead to the ejection abnormality) is present in the pressure chamber, then it is possible to prevent the ejection abnormalities caused by the presence of an air bubble in the pressure chamber, in advance.

Preferably, the threshold value setting device sets the threshold value according to a maximum value of the first determination signal generated by the determination element.

According to this aspect of the present invention, since the threshold value is set on the basis of the maximum value of the determination signal, which is correlated with the size of the air bubble, then it is possible to evaluate the size of the air bubble by means of such a simple method.

Preferably, the liquid ejection apparatus further comprises a reference maximum value storage device which stores the maximum value of the first determination signal as a reference maximum value, wherein the determination element further generates a second determination signal corresponding to the pressure in the pressure chamber; and the threshold value setting device sets the threshold value to a differential value between the reference maximum value stored in the reference maximum value storage device, and a maximum value of the second determination signal generated by the determination element.

According to this aspect of the present invention, since the differential between a previously stored reference maximum value and a determination signal obtained from the determination device is acquired and is set as the threshold value, then it is possible to evaluate the size of the air bubble with good accuracy.

The maximum value storage device may also function as another storage device (storage element).

It is also possible to set the threshold value to a value obtained by adding the differential between the reference maximum value and the maximum value of the determination signal obtained from the determination element, to a predetermined reference threshold value. Desirably, the liquid ejection apparatus comprises a storage device (threshold value storage device) storing an initial threshold value (default value) which is used as the reference threshold value.

Preferably, the liquid ejection head includes a plurality of the nozzles, a plurality of the pressure chambers corresponding to the nozzles, and a plurality of the determination elements corresponding to the pressure chambers; and the threshold value setting device sets the threshold value for each of the pressure chambers.

According to this aspect of the present invention, since threshold values are set respectively for the plurality of nozzles (or for the plurality of pressure chambers), then desirable air bubble evaluation in which the individual differences (variations) between the pressure determination elements provided in the pressure chambers are taken account of, is carried out.

In order to attain the aforementioned object, the present invention is directed to an air bubble determination method for a liquid ejection head including a nozzle which ejects liquid, a pressure chamber provided to correspond to the nozzle, a pressure generating element which is disposed on a first wall surface of the pressure chamber and adjusts pressure in the pressure chamber, and a determination element which is disposed on a second wall surface of the pressure chamber and generates a determination signal corresponding to the pressure in the pressure chamber adjusted by the pressure generating element, the air bubble determination method comprising the steps of: adjusting the pressure in the pressure chamber by driving the pressure generating element; acquiring the determination signal generated by the determination element when the pressure in the pressure chamber is adjusted by the pressure generating element; setting a threshold value according to the determination signal generated by the determination element; acquiring a comparison result obtained by comparing the determination signal with the threshold value; and acquiring an evaluation result obtained by evaluating a size of an air bubble present in the pressure chamber according to the comparison result.

In the step of generating (adjusting) the pressure in the pressure chamber, the pressure of prescribed pressure value in the pressure chamber may be generated (adjusted) by means of the pressure generating element in such a manner that liquid of a prescribed volume is ejected from the nozzle.

Preferably, the air bubble determination method further comprises the step of implementing an air bubble removal processing with respect to the liquid ejection head according to the evaluation result.

Preferably, the threshold value is set, each time the pressure in the pressure chamber is adjusted by driving the pressure generating element; the comparison result is acquired by comparing the threshold value with the determination signal generated by the determination element, each time the pressure in the pressure chamber is adjusted by driving the pressure generating element; and the evaluation result is acquired by evaluating the size of the air bubble present in the pressure chamber, each time the pressure in the pressure chamber is adjusted by driving the pressure generating element.

According to this aspect of the present invention, it is possible to evaluate the size of the air bubble in real time, each time the pressure in the pressure chamber is adjusted (i.e., each time the pressure generation step is carried out). Furthermore, since the air bubble removal processing is carried out in real time, it is not necessary to perform a maintenance process at regular time intervals.

Preferably, the air bubble determination method further comprises the steps of: performing a restoration processing with respect to the liquid ejection head; and storing a maximum value of the determination signal as a reference maximum value, the determination signal being generated by the determination element when the pressure in the pressure chamber is adjusted by the pressure generating element immediately after the restoration processing is performed.

According to this aspect of the present invention, the maximum value of the determination signal obtained when the pressure in the pressure chamber is generated (adjusted) immediately after carrying out the restoration processing (i.e., the maximum value of the determination signal obtained in an ideal state where there is no air bubble), is stored as the reference maximum value.

The term "immediately after the restoration processing" may also include a time period from the end of the restoration processing step until the pressure generating elements is driven by means of a prescribed drive signal.

According to the present invention, the threshold value is set on the basis of the determination signal which is obtained from the determination element and is directly proportional to the pressure in the pressure chamber, and furthermore the size of an air bubble present in the pressure chamber is evaluated on the basis of the result of comparison between the threshold value and the waveform of the determination signal. Therefore, it is possible to determine the size of the air bubble occurring in the pressure chamber by means of a simple composition, and furthermore, improved determination accuracy is expected.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
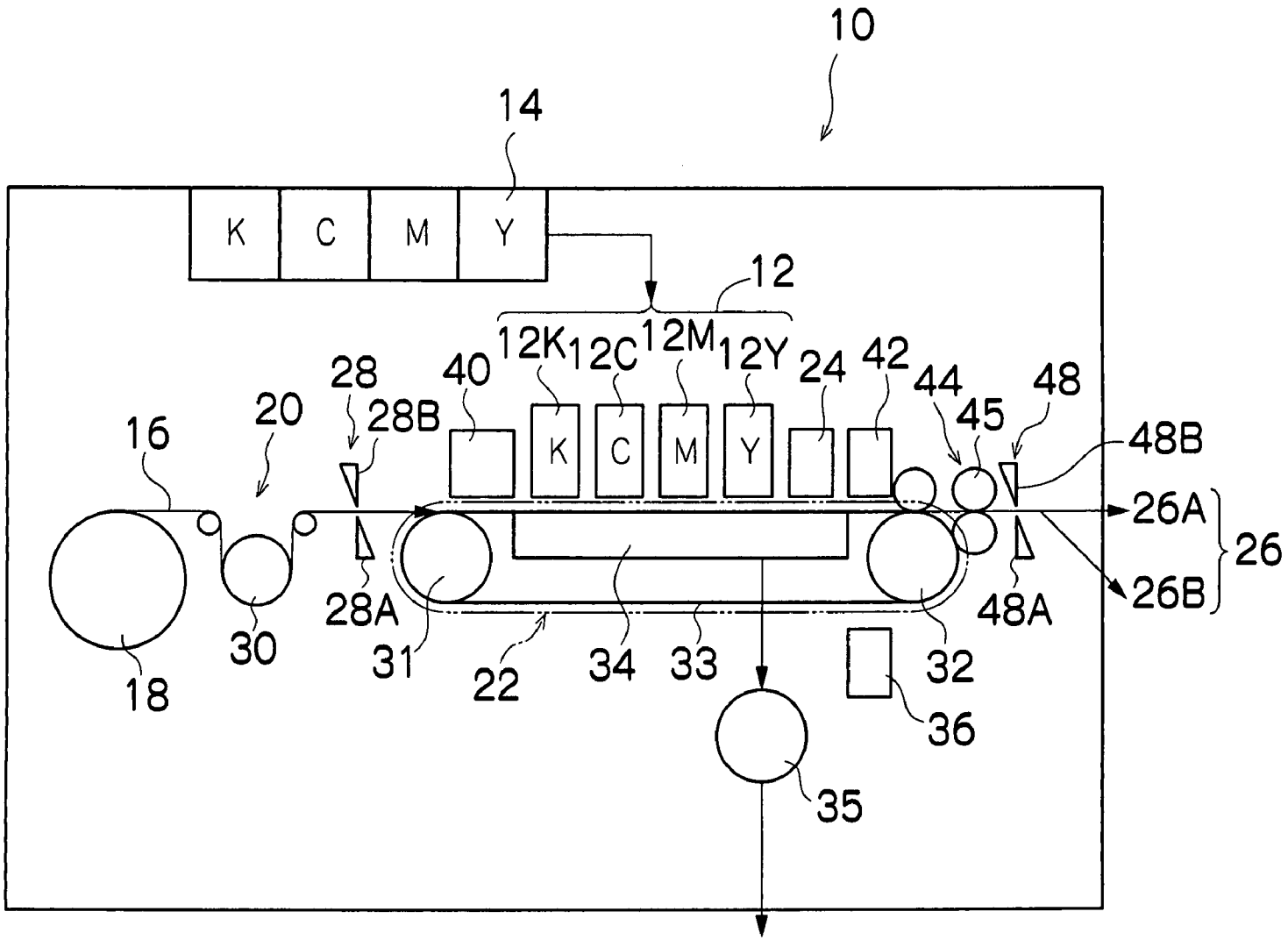
FIG. 1 is a general schematic drawing of an inkjet recording apparatus relating to an embodiment of the present invention.

FIG. 1 is a general configuration diagram of an inkjet recording apparatus (a liquid ejection apparatus) according to an embodiment of the present invention. As shown in FIG. 1, the inkjet recording apparatus 10 comprises: a printing unit 12 having a plurality of inkjet heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; and a paper output unit 26 for outputting image-printed recording paper (printed matter) to the exterior.

The ink storing and loading unit 14 has ink supply tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

As shown in FIG. 1, a composition which has a magazine for rolled paper (continuous paper) as an embodiment of the paper supply unit 18 is adopted; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper 16 can be used, it is preferable that an information recording medium such as a bar code and a wireless tag containing information about the type of paper is attached to the magazine, and by reading the information contained in the information recording medium with a predetermined reading device, the type of recording paper 16 to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has the curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface, and the round blade 28B is disposed on the printed surface side across the conveyor pathway. When cut papers are used, the cutter 28 is not required.

The recording paper 16 that is decurled and cut is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping a brush roller and a water absorbent roller, an air blow configuration in which clean air is blown, or a combination of these. In the case of the configuration of nipping the cleaning rollers, it is preferable to make the line velocity of the cleaning rollers different from that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
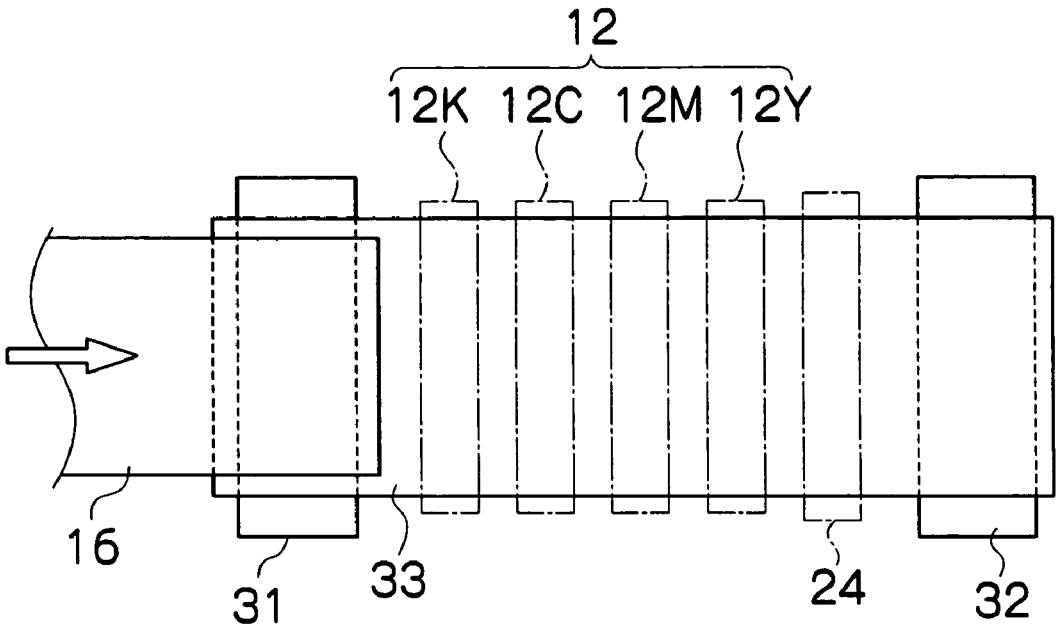
FIG. 2 is a principal plan diagram of the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording paper 16 (i.e., the full width of the printable range) (see FIG. 2).

The heads 12K, 12C, 12M and 12Y are arranged in color order (black (K), cyan (C), magenta (M), yellow (Y)) from the upstream side in the feed direction (paper feed direction) of the recording paper 16, and these heads 12K, 12C, 12M and 12Y are fixed extending in a direction substantially perpendicular to the paper conveyance direction.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation (one sub-scanning operation) of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is adopted in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Liquid Ejection Head

Next, the structure of a liquid ejection head (hereinafter referred to as a head) is described. The heads 12K, 12C, 12M and 12Y of the respective ink colors have the same structure, and a reference numeral 50 is hereinafter designated to any of the heads.

Figure 3A:
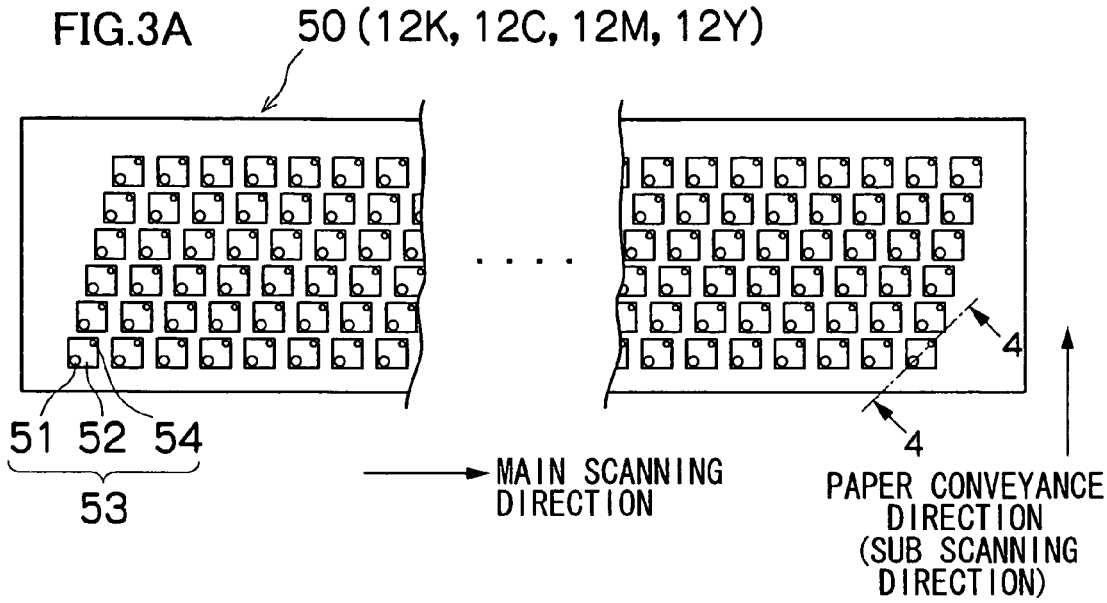
FIGS. 3A to 3C are plan view perspective diagrams showing embodiments of the composition of a head.
Figure 3B:
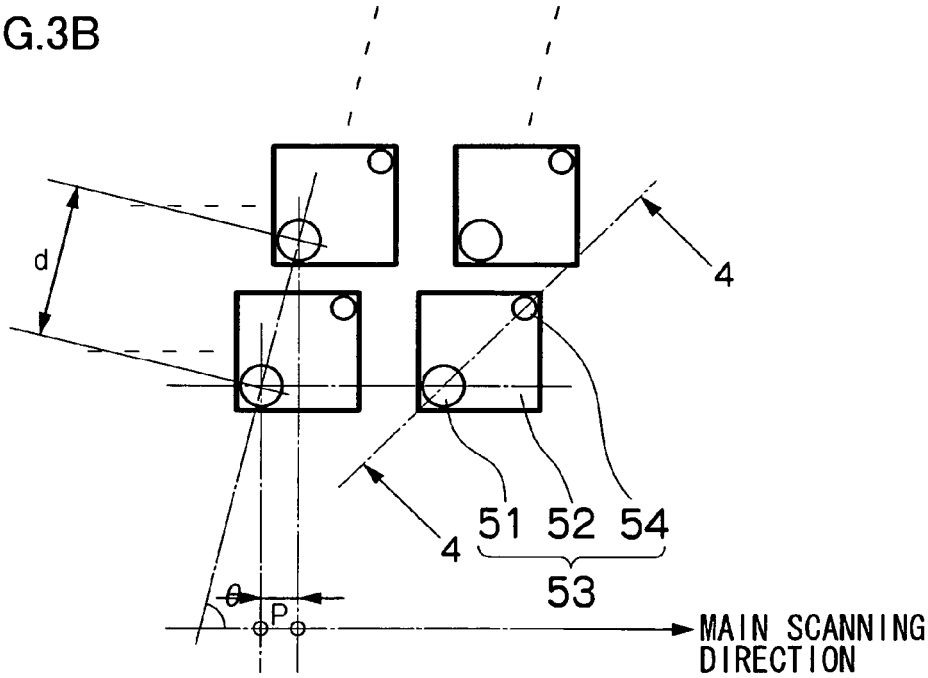
Figure 3C:
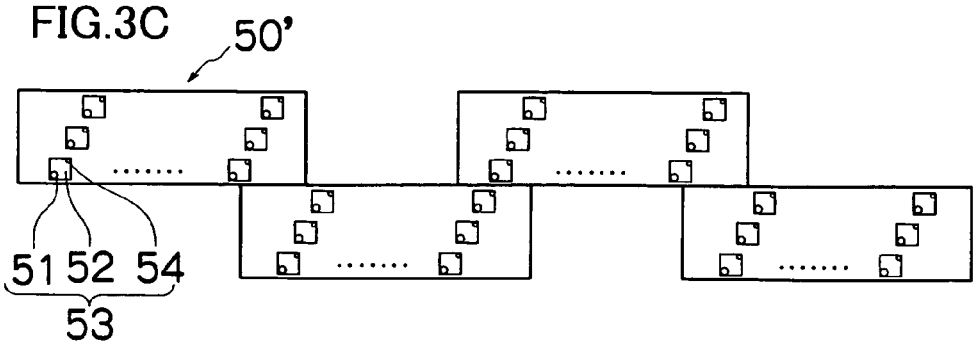
Figure 5:
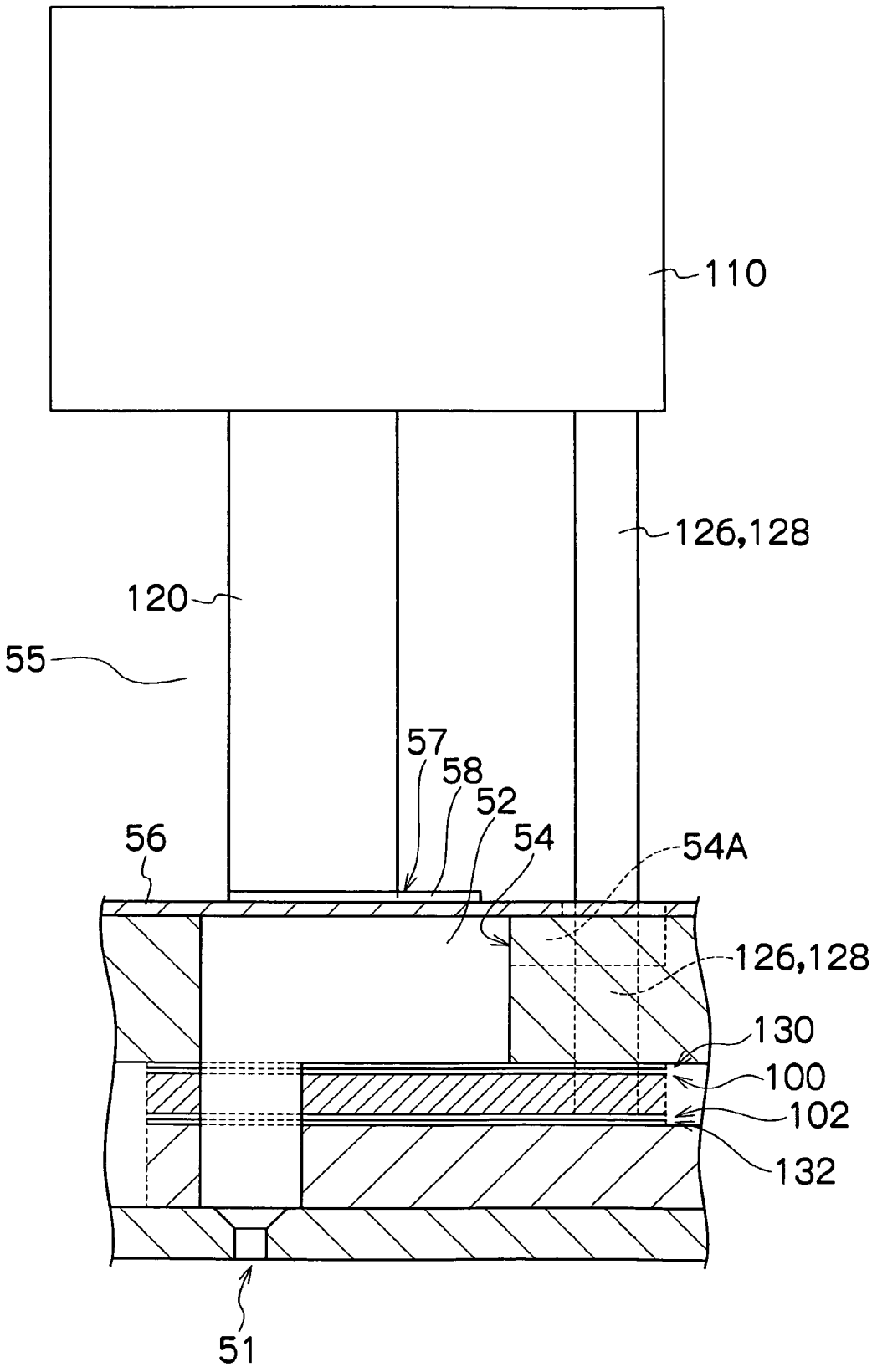
FIG. 5 is a cross-sectional diagram showing a further embodiment of the structure of the head shown in FIG. 4.

FIG. 3A is a plan view perspective diagram showing an embodiment of the structure of a head 50, and FIG. 3B is an enlarged diagram of a portion of same. Furthermore, FIG. 3C is a plan view perspective diagram showing a further embodiment of the composition of a head 50, and FIG. 5 is a cross-sectional diagram showing a three-dimensional composition of an ink chamber unit (being a cross-sectional view along line 4-4 in FIGS. 3A and 3B).

The nozzle pitch in the head 50 is required to be minimized in order to maximize the density of the dots formed on the surface of the recording paper 16. As shown in FIGS. 3A to 3C, the head 50 according to the present embodiment has a structure in which a plurality of ink chamber units (ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main-scanning direction perpendicular to the paper conveyance direction) is reduced and high nozzle density is achieved.

The composition of forming one or more nozzle rows through a length corresponding to the entire width of the recording paper 16 in a direction substantially perpendicular to the conveyance direction of the recording paper 16 is not limited to the embodiment described above. For example, instead of the configuration as described with reference to FIG. 3A, a line head having nozzle rows of a length corresponding to the entire width of the recording paper 16 can be formed by arranging and combining, in a staggered matrix, short head blocks 50' having a plurality of nozzles 51 arrayed in a two-dimensional fashion, as shown in FIG. 3C.

The present embodiment describes an aspect in which the planar shape of the pressure chambers 52 is substantially a square shape, but the planar shape of the pressure chambers 52 is not limited to a substantially square shape, and it is possible to adopt various other shapes, such as a substantially circular shape, a substantially elliptical shape, a substantially parallelogram (diamond) shape, or the like. Furthermore, the arrangement of the nozzles 51 and the supply ports 54 is not limited to the arrangement shown in FIGS. 3A to 3C, and it is also possible to arrange nozzles 51 substantially in the central region of the pressure chambers 52, or to arrange the supply ports 54 in the side walls of the pressure chambers 52.

As shown in FIG. 3B, the high-density-nozzle head according to the present embodiment is achieved by arranging a plurality of nozzles in a lattice configuration, according to a fixed arrangement pattern following a row direction which is aligned with the main scanning direction, and an oblique column direction which forms a prescribed, non-perpendicular angle θ with respect to the main scanning direction.

In other words, by adopting a structure in which a plurality of ejection elements 53 are arranged at a uniform pitch d in line with a direction forming an angle of θ with respect to the main scanning direction, the pitch P of the nozzles 51 projected to an alignment in the main scanning direction is d×cos θ, and hence it is possible to treat the nozzles as if they are arranged linearly at a uniform pitch of P. By means of this composition, it is possible to achieve a nozzle composition of high density, in which the nozzle columns projected to an alignment in the main scanning direction reach a total of 2400 per inch (2400 nozzles per inch).

When implementing the present invention, the arrangement structure of the nozzles is not limited to the embodiment shown in FIG. 3A, and it is also possible to apply various other types of nozzle arrangements, such as an arrangement structure having one nozzle row in the sub-scanning direction.

Figure 4:
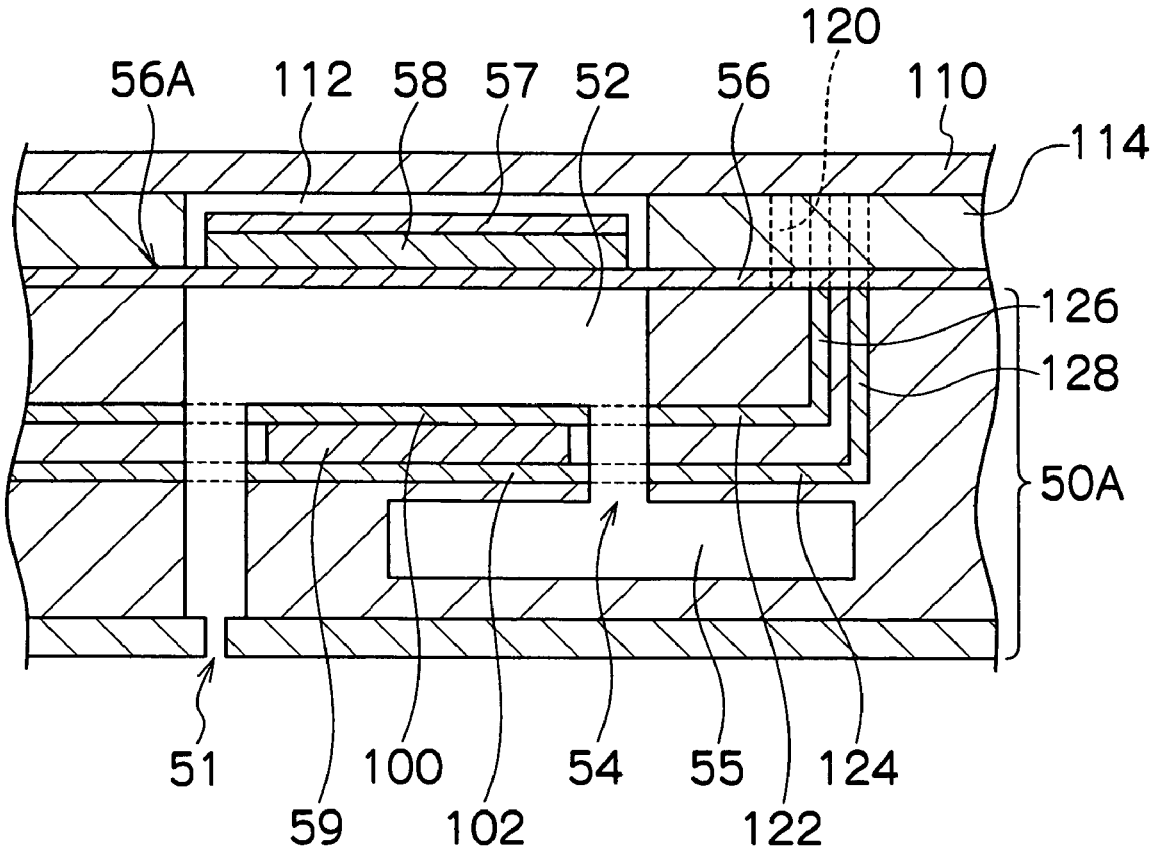
FIG. 4 is a cross-sectional diagram showing the three-dimensional structure of a head.

FIG. 4 is a cross-sectional diagram showing the three-dimensional composition of ejection elements 53. As shown in FIG. 4, a piezoelectric actuator 58 (pressure generating device) provided with an individual electrode 57 is bonded to a pressure plate 56. The pressure plate 56 forms the upper face of the pressure chambers 52 and also serves as a common electrode. The piezoelectric actuator 58 is deformed when a drive voltage (drive signal) is supplied to the individual electrode 57, thereby causing ink to be ejected from the nozzle 51. When ink is ejected, new ink is supplied to the pressure chamber 52 from a common flow passage 55, via the supply port 54.

On the other hand, if a sensor 59 (determination element) provided on the opposite side of the pressure chamber 52 from the piezoelectric actuator 58 receives the pressure due to ejection or refilling of the ink, or the like, then distortion (stress) corresponding to the pressure occurs in the sensor 59, and a voltage corresponding to the distortion is obtained from the sensor 59 as a determination signal (sensor signal). In other words, it is possible to extract the voltage (waveform) corresponding to the pressure generated in the pressure chamber 52, from the sensor 59.

In this inkjet recording apparatus 10, the size of an air bubble present in the pressure chamber 52 is determined on the basis of the sensor signal obtained from the sensor 59, and it is judged whether or not the ejection abnormality has occurred in the nozzle 51 connected to the pressure chamber 52, on the basis of the determined size of the air bubble.

The sensor 59 is provided with extraction electrodes 100 and 102 for the sensor signal, which are provided respectively on the surface adjacent to the pressure chamber and the surface opposite to the pressure chamber, in such a manner that the sensor signal is obtained from the extraction electrode 100 on the pressure chamber side and the extraction electrode 102 on the side opposite to the pressure chamber.

It is possible to adopt a floating-output type of sensor in which the extraction electrode 102 outputs an inverted signal which is equivalent to a signal obtained by inverting the sensor signal output from the extraction electrode 100, for the sensor 59 shown in the present embodiment. In other words, the sensor signal obtained from the extraction electrode 100 and the sensor signal obtained from the extraction electrode 102 have substantially the same phase and have a mutually inverse relationship.

The surface of the extraction electrode 100 on the pressure chamber side and the surface of the extraction electrode 102 on the opposite side to the pressure chamber 52 are insulated. It is preferable that a cavity part is provided on the opposite side of the extraction electrode 102 of the sensor 59 from the pressure chamber 52, in such a manner that the displacement of the sensor 59 is not obstructed.

Furthermore, a flexible cable 110 (a flexible printed circuit board) having a wiring pattern (not shown) for transmitting drive signals to be applied to the piezoelectric actuators 58 and sensor signals obtained from the sensors 59 is provided on the opposite side of the piezoelectric actuators 58 from the pressure plate 56. Between the flexible cable 110 and the pressure plate 56, a cavity part 112 between the piezoelectric actuator 58 and the flexible cable 110 is formed, and a supporting member 114 which supports the flexible cable 110 from below is provided.

By providing the cavity part 112 to the upper side of each piezoelectric actuator 58 (between the piezoelectric actuator 58 and the flexible cable 110), it is possible to suppress loss of the pressure generated by the piezoelectric actuators 58, without restricting the displacement of the piezoelectric actuators 58 when the piezoelectric actuators 58 are driven.

The flexible cable 110 has a conducting layer made of copper, or the like, which is surrounded by supporting layer (insulating layer) made of a resin material, such as epoxy or polyimide. In the present embodiment, the flexible cable used has a multi-layer structure in which a three or more conducting layers and a plurality of supporting layers are bonded together alternately.

The individual electrodes 57 of the piezoelectric actuators 58 are connected to horizontal wires (not shown) formed on the piezoelectric actuator installation surface 56A of the pressure plate 56 (in other words, the individual electrodes 57 are extended onto the piezoelectric actuator installation surface of the pressure plate 56 and are bonded electrically to the horizontal wires), and each of the horizontal wires is connected to a vertical wire 120 (indicated by broken lines in the diagram) penetrating through the supporting member 114. Moreover, the vertical wires 120 are electrically connected to the wiring pattern of the flexible cable 110.

In other words, the drive signals to be supplied to the piezoelectric actuators 58 are transmitted from the head driver (reference numeral "84" in FIG. 7) to the individual electrodes 57 of the piezoelectric actuators 58, through the wiring pattern of the flexible cable 110, the vertical wires 120, and the horizontal wires (not shown).

Figure 7:
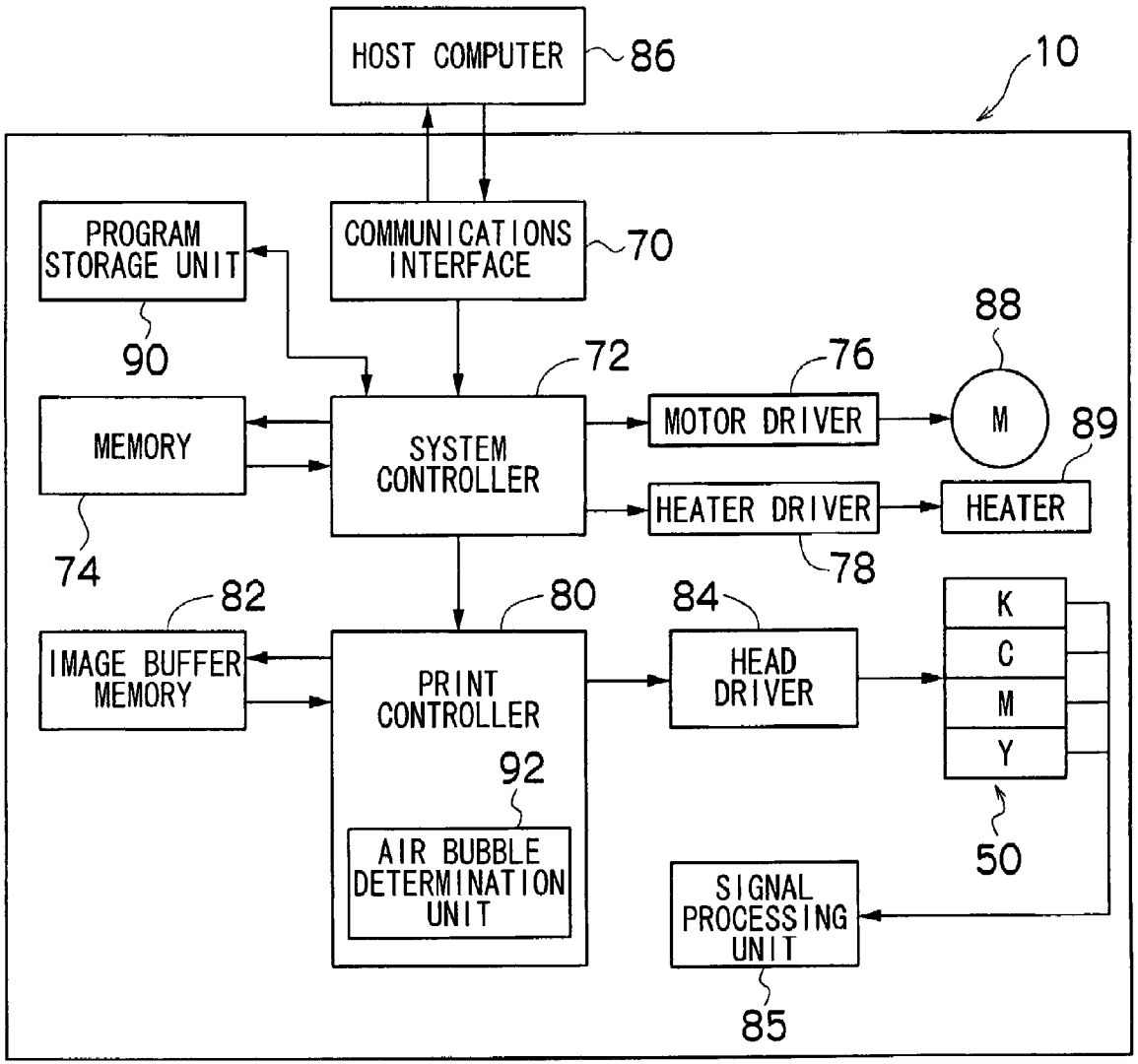
FIG. 7 is a principal block diagram showing the system configuration of the inkjet recording apparatus shown in FIG. 1.

Furthermore, the sensor signals obtained from the sensors 59 are supplied to the signal processing unit 85 shown in FIG. 7, via the extraction electrodes 100 and 102, horizontal wires 122 and 124 connected respectively to the extraction electrodes 100 and 102, vertical wires 126 and 128 penetrating the flow channel structure 50A and the supporting member 114, the pressure plate 56, the supporting member 114, and the wiring pattern of the flexible cable 110.

In other words, the drive signal wires, along which the drive signals are transmitted, include the wiring pattern of the flexible cable 110, the vertical wire 120, and the horizontal wire (not shown), and the sensor signal wires, along which the sensor signals are transmitted, include the wiring pattern of the flexible cable 110, the vertical wires 126 and 128, and the horizontal wires 122 and 124.

For the piezoelectric actuator 58 shown in FIG. 4, it is suitable to adopt a piezoelectric element using ceramic material such as PZT ($Pb(Zr—Ti)O_3$, lead zirconate titanate). For the sensor 59, it is suitable to adopt a piezoelectric element using a fluoride resin material, such as a PVDF (polyvinylidene-fluoride) or PVDF-TrFE (a copolymer of polyvinylidene fluoride and trifluoride ethylene).

In general, for an actuator which generates the ejection force, it is desirable to use a piezoelectric element having large absolute values of the equivalent piezoelectric constants (d constant, electrical-mechanical conversion constant, piezoelectric strain constant) and excellent drive characteristics; and for a sensor which determines pressure, it is desirable to use a piezoelectric element having large values for the piezoelectric output coefficients (g constant, mechanical relectrical conversion constant, piezoelectric stress constant) and excellent determination characteristics. In other words, a ceramic material, such as PZT, is suitable for the piezoelectric element having excellent drive characteristics, whereas a fluorine-based resin material, such as PVDF or PVDF-TrFE, is suitable for the piezoelectric element having excellent determination characteristics. PZT is basically composed of lead titanate ($PbTiO_3$) ,which is a ferroelectric material, and lead zirconate ($PbZrO_3$), which is an antiferroelectric material. By changing the mixing ratio of the two components, it is possible to control various properties of the ceramic material, such as the piezoelectric, dielectric and elastic characteristics.

The piezoelectric actuator 58 which applies the ejection force to the ink inside the pressure chamber 52, and the sensor 59 which determines the pressure inside the pressure chamber 52 are not restricted to being arranged in the positions shown in FIG. 4, and a configuration is possible in which the piezoelectric actuator 58 and the sensor 59 is provided on the same wall of the pressure chamber 52, or on different walls of the pressure chamber 52 respectively. Furthermore, a mode is also possible in which the piezoelectric actuator 58 and the sensor 59 are provided inside the pressure chamber 52. In a mode where the piezoelectric actuator 58 and the sensor 59 are provided inside the pressure chamber 52, a prescribed ink resistance processing (insulation treatment) is applied to the parts of the piezoelectric actuator 58 and the sensor 59 that are exposed to the ink.

FIG. 5 illustrates a further embodiment of the structure of a head 50. The head 50 shown in FIG. 5 has a vertical wire 120 which is formed so as to rise up in a vertical direction from the individual electrode 57 of the piezoelectric actuator 58 which is provided corresponding to each pressure chamber 52.

Furthermore, the vertical wires 126 and 128, which transmit the sensor signals, are formed so as to rise up from the extraction electrodes 100 and 102 for the sensor 59 and pass through the flow channel structure 50A, the pressure plate 56, and the space where the vertical wires 120 are erected (i.e., formed so as to be erected in the space where the vertical wires 120 are disposed). The reference numerals 130 and 132 shown in FIG. 5 denote an insulating layer (protecting layer) formed on the pressure chamber side of the extraction electrodes 100 for the sensors 59, and an insulating layer formed on the opposite side of the extraction electrodes 102 from the pressure chambers, respectively.

In this way, the space in which the column-shaped vertical wires 120, 126 and 128 are erected between the pressure plate 56 and the flexible cable 110 forms a common flow channel (common liquid chamber) 55 for supplying ink to the pressure chambers 52 via supply side flow channels 54A and supply ports (supply restrictors) 54.

FIG. 5 shows just a single ejection element 53 and only a portion of the common flow channel 55 and the flexible cable 110, but the common flow channel 55 of the present embodiment constitutes one large space formed over the whole region in which the pressure chambers 52 are formed, in order to supply ink to all of the pressure chambers 52 shown in FIG. 3A. The structure of the common flow channel 55 is not limited to one in which it is formed as a single large space in this way, and it may also be formed as a plurality of spaces by dividing into several regions.

The vertical wires 120, 126 and 128 shown in FIG. 5 support the flexible cable 110 from below and create a space which forms the common flow channel 55. The vertical wires 120 which rise up as columns in this way may be referred to as "electrical columns", and the vertical wires 126 and 128 may be referred to as "sensor columns". In the present embodiment, each of the vertical wires 120 is formed in a one-to-one correspondence with each of the piezoelectric actuators 58, and the vertical wires 126 and 128 are formed respectively in a one-to-one correspondence with the extraction electrodes 100 and 102 for the sensors 59. In order to reduce the number of wires, the wires corresponding to a plurality of piezoelectric actuators 58 may be gathered together into a single vertical wire 120, and the wires corresponding to a plurality of sensors 59 may be gathered into single vertical wires 126 and 128.

Description of on an Ink Supply System

Figure 6:
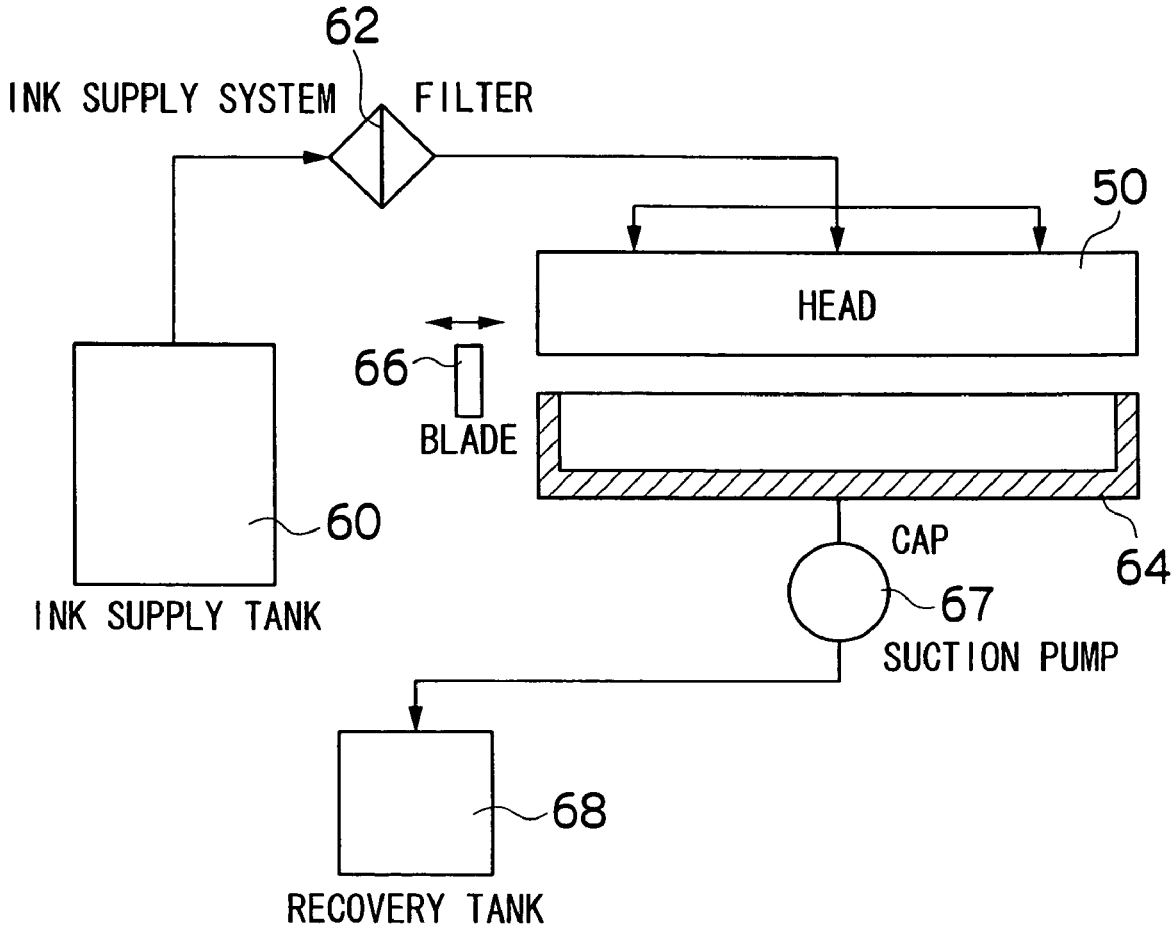
FIG. 6 is a block diagram showing the approximate composition of an ink supply system of the inkjet recording apparatus shown in FIG. 1.

FIG. 6 is a schematic drawing showing the configuration of the ink supply system in the inkjet recording apparatus 10.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and air bubbles is disposed between the ink supply tank 60 and the head 50 as shown in FIG. 6. Preferably, the filter mesh size is not greater than the diameter of the nozzle and commonly about 20 μm.

Although not shown in FIG. 6, it is preferable to provide a sub-tank integrally to the head 50 or nearby the head 50. The sub-tank has a damper function for preventing variation in the internal pressure of the head and a function for improving refilling of the head.

The inkjet recording apparatus 10 is also provided with a cap 64 as a device to prevent the nozzles 51 from drying out or to prevent an increase in the ink viscosity in the vicinity of the nozzles, and a cleaning blade 66 as a device to clean the nozzle face. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In the situation described above, it is difficult to eject ink from the nozzle 51, even if the piezoelectric actuator 58 is operated.

Therefore, before a situation of this kind develops (i.e., while the ink is within a range of viscosity which allows it to be ejected by operation of the piezoelectric actuator 58), the piezoelectric actuator 58 is operated, and a preliminary ejection ("purge", "blank ejection", "liquid ejection" or "dummy ejection") is carried out toward the cap 64 (ink receptacle), in order to expel the degraded ink (i.e., the ink in the vicinity of the nozzle which has increased viscosity).

Furthermore, if air bubbles enter into the ink inside the head 50 (inside the pressure chamber 52), then even if the piezoelectric actuator 58 is operated, it is difficult to eject ink from the nozzle. In the case described above, the cap 64 is placed on the head 50, the ink (ink containing air bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

In the inkjet recording apparatus 10 described in the present embodiment, the ejection state of a nozzle 51 connected to a pressure chamber 52 is judged (evaluated) on the basis of the size of the air bubble present in the pressure chamber 52, and if it is judged that the air bubble greater than a prescribed size is present in the pressure chamber 52 and that the ejection abnormality is occurring in the corresponding nozzle 51, then a maintenance process (air bubble removal process), such as the suctioning described above, is carried out. In the present embodiment, a mode is adopted in which a cap 64 is placed in close contact with the head 50 and the ink inside the head 50 is then suctioned from the nozzles as an air bubble removal process. However, it is also possible to remove the air bubbles inside the pressure chambers 52 by means of processing other than suctioning.

The cleaning blade 66 is composed of rubber or another elastic member, and can slide on the ink ejection surface (surface of the nozzle plate) of the head 50 by means of a blade movement mechanism (a wiper) which is not shown in drawings. When ink droplets or foreign matter has adhered to the nozzle plate, the surface of the nozzle plate is wiped and cleaned by sliding the cleaning blade 66 on the nozzle plate. Preliminary ejection is performed in order to prevent foreign matters from entering the nozzle 51 in use of the blade when the ink ejection surface is cleaned by the blade mechanism.

Description of Control System

FIG. 7 is a principal block diagram showing the system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and a signal processing unit 85, and the like.

The communications interface 70 is an interface unit for receiving image data sent from a host computer 86. A serial interface such as USB (universal serial bus), IEEE 1394, Ethernet™, wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communications interface 70, memory 74, motor driver 76, heater driver 78, and the like, as well as controlling communications with the host computer 86 and writing and reading to and from the memory 74, and it also generates control signals for controlling motors of the conveyance system such as the motor 88 and heaters such as the heater 89 for the post drying unit 42.

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (drive circuit) which drives the motor 88 in accordance with instructions from the system controller 72. Furthermore, the heater driver 78 is a driver which drives the post drying unit 42, and the heater 89 of the temperature adjustment heater in the inkjet recording apparatus 10 and in the head 50, and the like, in accordance with instructions from the system controller 72.

The print controller 80 has a signal processing function for performing various tasks, such as correction processing and other types of processing for generating print control signals from the image data stored in the memory 74 in accordance with commands from the system controller 72, and the print controller 80 supplies the generated print data (dot data) to the head driver 84. Prescribed signal processing is carried out in the print controller 80, and the ejection amount and the ejection timing of the ink droplets from the respective heads 50 are controlled via the head driver 84, on the basis of the print data. By this means, desired dot size and dot positions are achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the piezoelectric actuators 58 of the heads of the respective colors, 12K, 12C, 12M and 12Y, on the basis of print data supplied by the print control unit 80. In other words, in the head driver 84, drive signals to be supplied to the piezoelectric actuators 58 are generated on the basis of the dot data obtained from the print controller 80, and the drive signals are supplied to the respective piezoelectric actuators 58 via the prescribed circuitry and wiring. In order to maintain uniform driving conditions in each head, a feedback control system may also be incorporated into the head driver 84.

The image data to be printed is externally inputted through the communications interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to each head 50, the ink is ejected from each head 50. By controlling the ink ejection from the heads 50 in synchronization with the conveyance velocity of the recording paper 16, an image is formed on the recording paper 16.

The signal processing unit 85 is a signal processing block which carries out prescribed signal processing on the sensor signals obtained from the sensors 59 in accordance with the pressure in the pressure chambers 52 shown in: FIG. 4, compares each of the sensor signals with a prescribed threshold value, and sends the comparison results to an air bubble judgment unit 92 (judgment device) inside the print controller 80. In the inkjet recording apparatus 10, the size of the air bubbles present in the pressure chambers 52 is judged (evaluated) on the basis of the comparison results, and if there is an air bubble that is larger than a prescribed size, then the nozzle 51 connected to the pressure chamber 52 where this air bubble is present is judged to be in the ejection abnormality state. If the ejection abnormality state is determined, then the system controller 72 activates the cap movement mechanism (not shown) in such a manner that the cap 64 shown in FIG. 6 is placed tightly against the nozzle forming surface of the head 50, and removes the air bubbles inside the head 50 (pressure chambers 52) from the nozzles 51 by operating the suction pump 67 shown in FIG. 6. In other words, the system controller 72 shown in FIG. 7 functions as a device for controlling the maintenance process.

A detailed description of the signal processing unit 85 and the air bubble judgment control procedure is described later.

Various control programs are stored in the program storage unit 90 shown in FIG. 7, and the control program is read out and executed in accordance with commands from the system controller 72. As the program storage unit 90, a semiconductor memory such as a ROM or EEPROM, or a magnetic disk, or the like, may be used. The program storage unit 90 may be provided with an external interface, and a memory card or PC card may also be used as the program storage unit 90. Furthermore, of such storage media, various types of storage media may also be provided in combination. The program storage unit 90 may also function as a storage device (not shown) for storing operational parameters, and the like.

In the present embodiment, the system controller 72, the memory 74, the print controller 80, and the like, are depicted as separate functional blocks, but they may also be integrated to form one single processor. Furthermore, it is also possible to achieve a portion of the functions of the system controller 72 and a portion of the functions of the print controller 80, by one processor.

Description of the Signal Processing Unit

Figure 8:
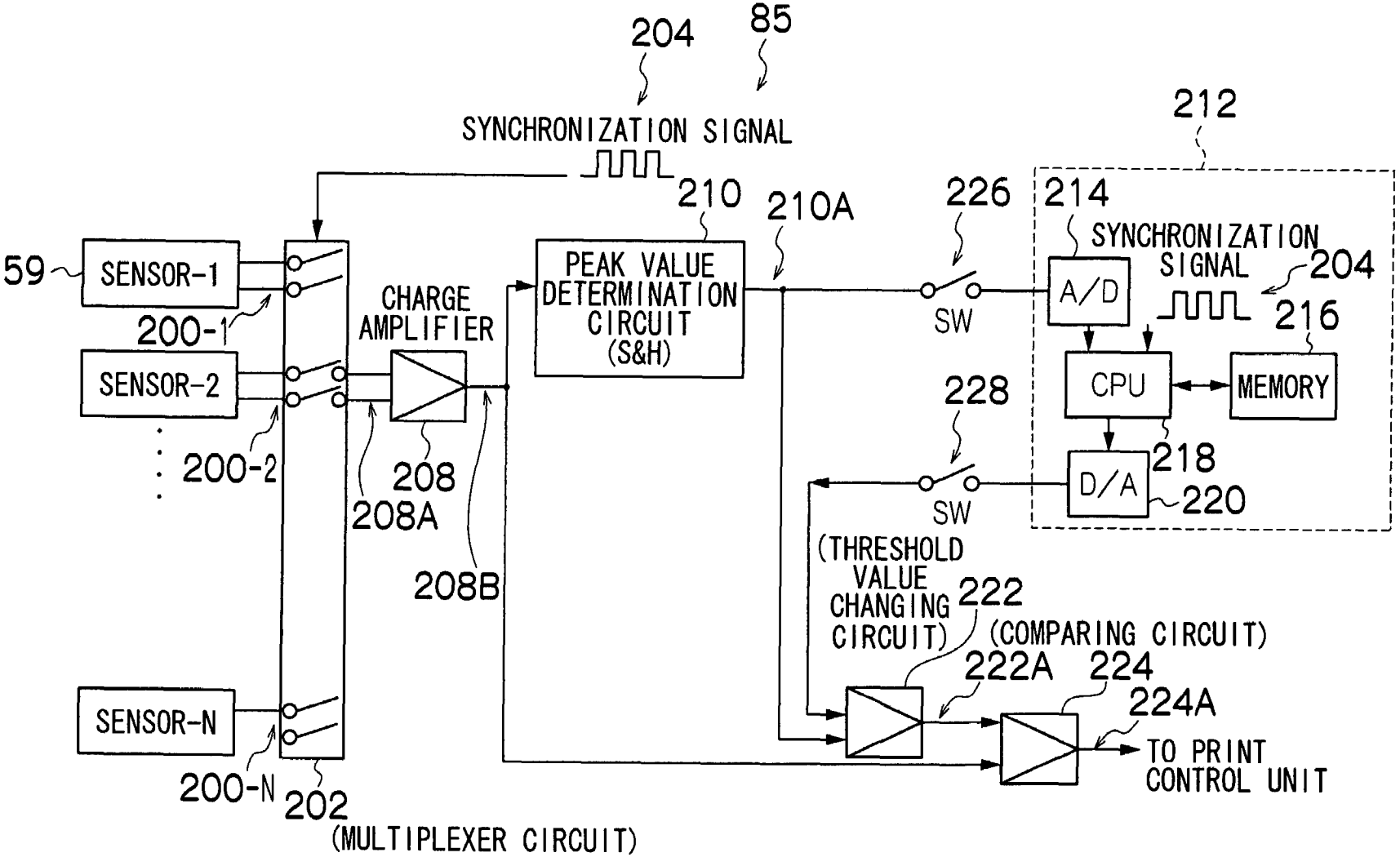
FIG. 8 is a block diagram showing the composition of the signal processing unit shown in FIG. 7.

Next, the signal processing unit 85 shown in FIG. 7 is described. FIG. 8 is a block diagram showing the approximate composition of the signal processing unit 85. The signal processing unit 85 comprises: a switch array (multiplexer circuits) 202 having N switching elements 200 (200-1 to 200-n) corresponding to the sensors 59 (the sensors 1 to N); a charge amplifier (amplification circuit) 208 which amplifies the sensor signals obtained from the sensors 59 (see FIG. 9A) at a prescribed gain; a peak value determination circuit 210 which determines the peak value of each sensor signal amplified by the charge amplifier 208 (see FIG. 9B), and a storage circuit 212 which stores the peak value determined by the peak value determination circuit 210.

Switching on and switching off of the switching elements 200 of the switch array 202 is controlled on the basis of a synchronization signal 204. In other words, the switch array 202 functions as a device for selecting the sensors that sensor signals are acquired from, from the sensors 59 (the sensors 1 to N), on the basis of the synchronization signal 204.

For the peak value determination circuit 210 which determines the peak value of each sensor signal, which is an analog signal, it is suitable to use a sample and hold (S&H) circuit.

The storage circuit 212 comprises: an A/D converter (A/D conversion circuit) 214 which converts the peak value determined by the peak value determination circuit 210 into digital data; a CPU 218 which stores the peak value (digital data) in a memory 216, on the basis of the synchronization signal 204 supplied to the switch array 202; and a D/A converter (D/A conversion circuit) 220 which converts the peak value read out from the memory 216 via the CPU 218, into an analog signal.

The CPU 218 used in the storage circuit 212 functions as a memory controller which controls the writing of data to the memory 216 and the read out of data from the memory 216. The CPU 218 may also be used as a processor including the system controller 72 and the print controller 80 shown in FIG. 7. Furthermore, the memory 216 may also be used as another memory, such as the memory 74 or the image buffer memory 82 shown in FIG. 7.

The signal processing unit 85 comprises: a threshold value changing circuit 222 which extracts the differential between the reference peak value stored in the storage circuit 212 and the peak value of the sensor signal obtained from each sensor 59, and changes a predetermined reference threshold value to the threshold value used for judging the air bubble size, on the basis of the differential; and a comparing circuit 224 which compares the threshold value obtained from (updated by) the threshold value changing (updating) circuit 222 with the sensor signal obtained from the charge amplifier 208.

In the composition shown in FIG. 8, the reference threshold value is set to 0V (i.e., no reference threshold value is provided). In the composition shown in FIG. 8, the differential of the peak value is set directly as the threshold value. By adopting a composition in which no reference threshold value is provided in this way, it is possible to omit the composition (processing) for adding the differential to the reference threshold value, and hence the composition and processing of the signal processing unit 85 are simplified.

The comparing circuit 224 includes a comparator circuit which outputs a rectangular wave (pulse) when the sensor signal which has undergone the prescribed signal processing becomes greater than the prescribed threshold value.

Furthermore, the signal processing unit 85 includes a switch 226 which opens and closes the circuit between the peak value determination circuit 210 and the storage circuit 212, and a switch 228 which opens and closes the circuit between the storage circuit 212 and the threshold value changing circuit 222.

In other words, at each ejection operation, the predetermined reference threshold value that is previously established on the basis of the peak value of the sensor signal obtained from each of the sensors 59 is updated (or set), and the size of the air bubble present in the corresponding pressure chamber 52 is judged on the basis of the updated threshold value.

Figure 9A:
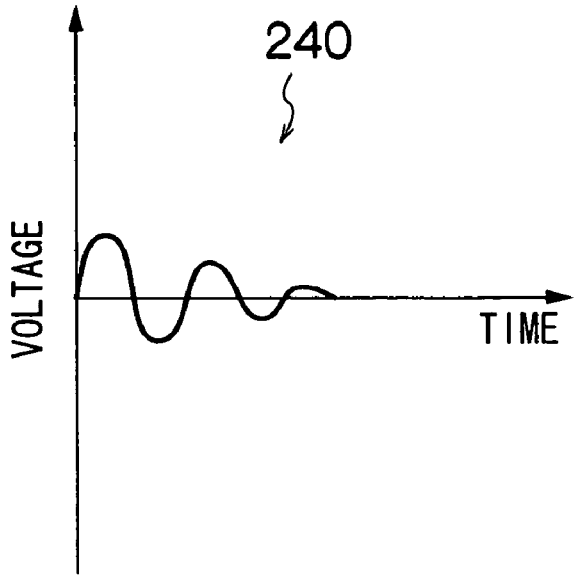
FIGS. 9A and 9B are diagrams showing a sensor signal obtained from a sensor.
Figure 9B:
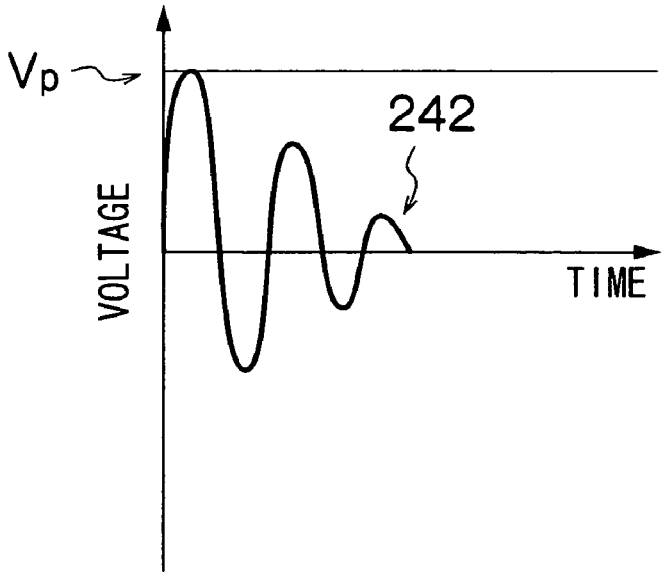

FIG. 9A is a diagram showing a sensor signal 240 obtained from each sensor 59 (a sensor signal input to the input part 208A of the charge amplifier 208), and FIG. 9B is a diagram showing a sensor signal 242 amplified by the charge amplifier 208 shown in FIG. 8 (a signal obtained from the output part 208B of the charge amplifier 208 in FIG. 8), and the peak value $V_p$ of the sensor signal 242 (the signal obtained from the output part 210A of the peak value determination circuit 210 in FIG. 8). If the sensors 59 shown in FIG. 8 have good sensitivity (i.e., if a sensor signal 240 obtained from each sensor 59 has a sufficient voltage which can be identified as a signal by the subsequent circuits), then the charge amplifier 208 shown in FIG. 8 is not necessary.

Description of Air Bubble Judgment Control

Figure 10:
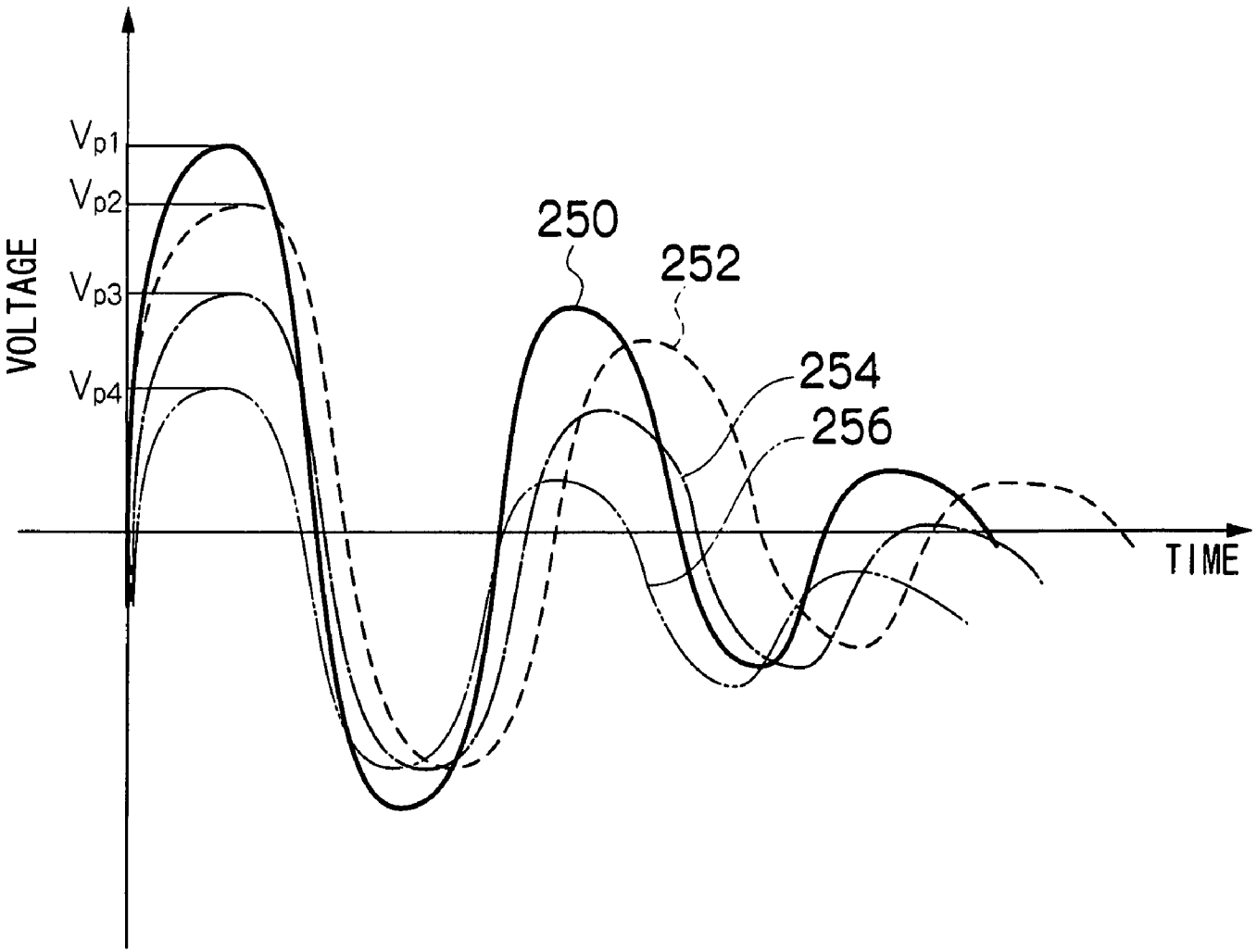
FIG. 10 is a diagram for describing the details of the sensor signal shown in FIGS. 9A and 9B.

Next, a sensor signal obtained from each sensor 59 (see FIG. 9A) is described: with reference to FIG. 10. A sensor signal obtained from each sensor 59 has a voltage directly proportional to the pressure in the pressure chamber 52. The sensor signal 250 denoted by the solid lines in FIG. 10 is the sensor signal in a case where the pressure of the pressure chamber 52 is normal and it has a peak value of $V_{p1}$.

Furthermore, the sensor signal 252 denoted by the broken line in FIG. 10 is the sensor signal in a case where an air bubble of small size (in the present embodiment, an air bubble having a diameter of approximately 10 μm to 20 μm) is present, the sensor signal 254 denoted by the single-dotted line is the sensor signal in a case where an air bubble of medium size (in the present embodiment, an air bubble having a diameter of approximately 30 μm to 120 μm) is present, and the sensor signal 256 denoted by the double-dotted line is the sensor signal in a case where an air bubble of large size (in the present embodiment, an air bubble having a diameter of 130 μm or larger) is present. FIG. 10 shows a typical example of sensor signals corresponding to pressure chambers where a small-size, medium-size and large-size air bubbles are present.

As shown in FIG. 10, the relationship between the peak value $V_{p1}$ of the sensor signal 250, the peak value $V_{p2}$ of the sensor signal 252, the peak value $V_{p3}$ of the sensor signal 254, and the peak value $V_{p4}$ of the sensor signal 256 is: $V_{p1}>V_{p2}>V_{p3}>V_{p4}$, and this relationship indicates that the peak value of the sensor signal becomes smaller as the size of the air bubble present in a pressure chamber 52 becomes larger.

When an air bubble occurs in a pressure chamber 52, the pressure loss proportional to the size of the air bubble occurs in the pressure of the pressure chamber 52. When this pressure loss becomes large, then the ejection abnormality occurs and the ink cannot be ejected normally from the nozzle 51 even if the prescribed ejection force is applied to the piezoelectric actuator 58. In other words, if the air bubble of a large size that affects ink ejection has occurred, then it is necessary to carry out a maintenance process promptly in the pressure chamber 52 and the nozzle 51 to be connected to the pressure chamber 52.

In the inkjet recording apparatus 10 shown in the present embodiment, if the sensor signal 256 corresponding to the large-sized air bubble that is liable to affect ink ejection or the sensor signal 254 corresponding to the medium-sized air bubble that is liable to affect ink ejection is obtained, then the ejection is judged abnormal (it is judged that pressure abnormality occurs in the pressure chamber 52). On the other hand, if the sensor signal 252 corresponding to the small-sized air bubble that dose not affect ejection or the normal sensor signal in the case where no air bubble is present is obtained, then it is judged that the ejection is normal (the pressure in the pressure chamber 52 is normal).

In other words, since the threshold value used for judging the air bubble size is updated in synchronism with the ejection operation, in accordance with the peak value $V_p$ of the amplified sensor signal 242 shown in FIG. 9B, then it is possible to judge the presence or absence of the ejection abnormality in the nozzle 51 connected to a pressure chamber 52, on the basis of the size of the air bubble in the pressure chamber 52.

More specifically, the differential ΔV between the reference peak value $V_{p0}$ which is the peak value of the sensor signal in the case of normal ejection and is previously stored in the memory 216 shown in FIG. 8, and the peak value $V_p$ which is the peak value of a sensor signal obtained from each sensor 59 during an ejection operation, is derived. The differential ΔV is added to a predetermined reference threshold value $V_{th0}$ to obtain a threshold value for judging the air bubble size in each ejection operation. The reference threshold value $V_{th0}$ is stored in the memory 216 in FIG. 8. The reference threshold value $V_{th0}$ may be stored as one of the system parameters.

A specific embodiment of changing (updating) the threshold value for judging the air bubbles at each ejection operation is described below with reference to FIGS. 11A to 14C. In the present embodiment, the predetermined reference threshold value $V_{th0}$ is set to 0V. In other words, FIGS. 11A to 14C show an embodiment where there is no reference threshold value $V_{th0}$ and the derived differential ΔV is directly set as the threshold value.

Figure 11A:
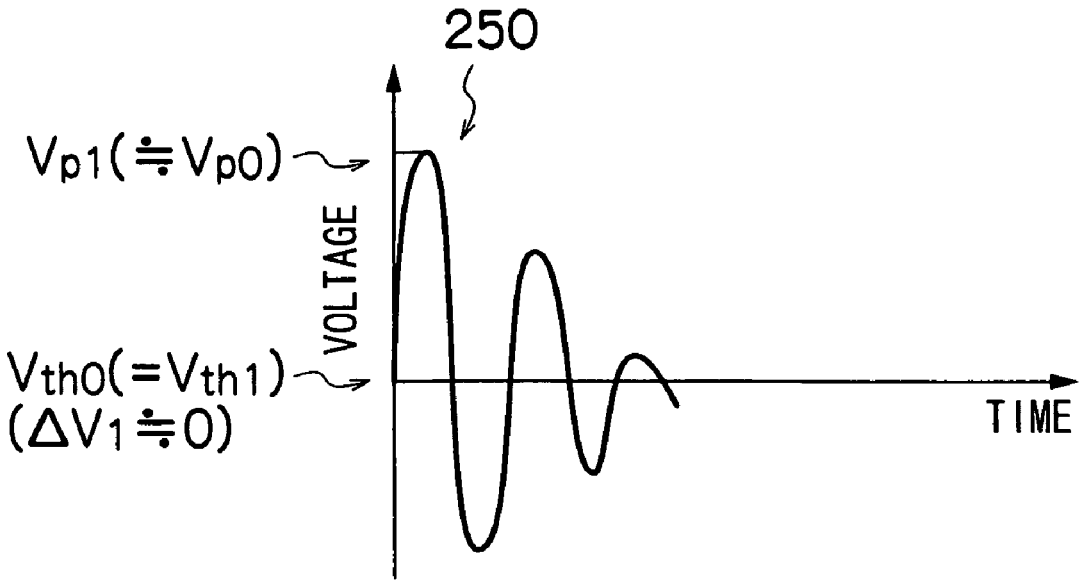
FIGS. 11A and 11B are diagrams for describing a sensor signal and a pulse signal during normal ejection.
Figure 11B:
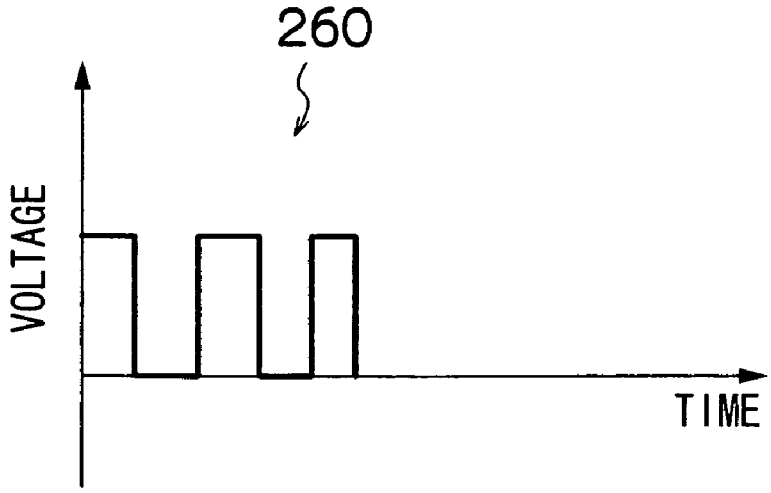

FIG. 11A is a diagram showing a sensor signal 250 in the state where no air bubble is present inside a pressure chamber 52 (see FIG. 10; a signal obtained from the output part 208B of the charge amplifier 208 in FIG. 8). The sensor signal 250 shown in FIG. 11A has the peak value $V_{p1}$ which is substantially the same as the reference peak value $V_{p0}$ stored in the memory 216 of the FIG. 8 (i.e., $V_{p0}\approx V_{p1}$), and therefore the differential $\Delta V_1$ between the reference peak value $V_{p0}$ and the peak value $V_{p1}$ of the sensor signal 250 is substantially zero. Consequently, the threshold value $V_{th1}$ which is obtained by updating the reference threshold value $V_{th0}$, is substantially the same as the reference threshold value $V_{th0}$ ($V_{th0}$ is changed to the threshold value $V_{th1}$, where $V_{th1}=V_{th0}$). Accordingly, as a result of comparing the threshold value $V_{th1}$ (which is equal to the reference threshold value $V_{th0}$) with the sensor signal 250, a pulse signal 260 having three rectangular waves (pulses) is obtained from the output part 224A of the comparing circuit 224 in FIG. 8, as shown in FIG. 11B.

Figure 12A:
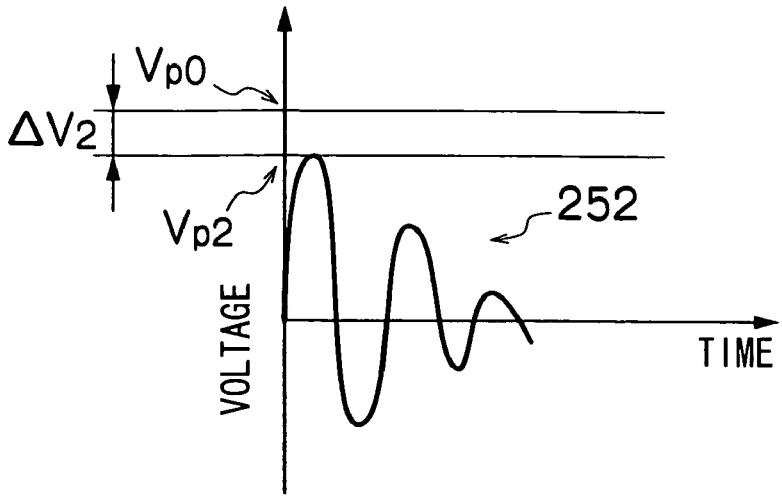
FIGS. 12A to 12C are diagrams for describing a sensor signal and a pulse signal in a case where a small-size air bubble has occurred.

FIG. 12A is a diagram showing a sensor signal 252 in the state where a small-size air bubble has occurred inside a pressure chamber 52 (see FIG. 10; a signal obtained from the output part 208B of the charge amplifier 208 in FIG. 8).

Figure 12B:
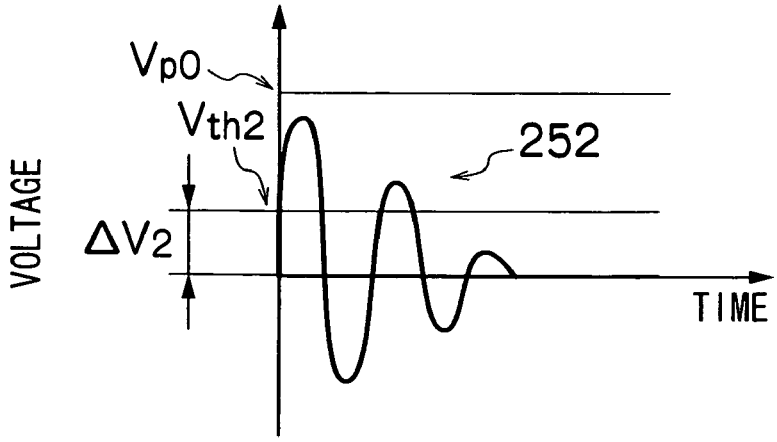

The sensor signal 252 shown in FIG. 12A has the peak value $V_{p2}$ which is smaller than the reference peak value $V_{p0}$, and as shown in FIG. 12B, the threshold value $V_{th2}$ ($=V_{th0}+\Delta V_2$) which is derived by adding $\Delta V_2$ ($=V_{p0}-V_{p2}$) to the reference threshold value $V_{th0}$ is obtained from the output part 222A of the threshold value changing circuit 222 in FIG. 8.

Figure 12C:
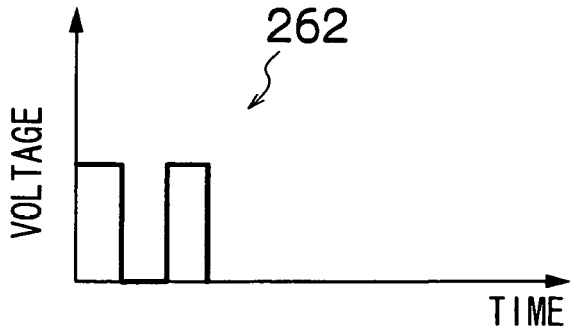

The threshold value $V_{th2}$, which is obtained by changing the reference threshold value $V_{th0}$ (i.e., is obtained by updating the reference threshold value) in this way, and the sensor signal 252 are compared by the comparing circuit 224 in FIG. 8, and thus a pulse signal 262 having two square waves is obtained from the output part 224A of the comparing circuit 224, as shown in FIG. 12C.

Figure 13A:
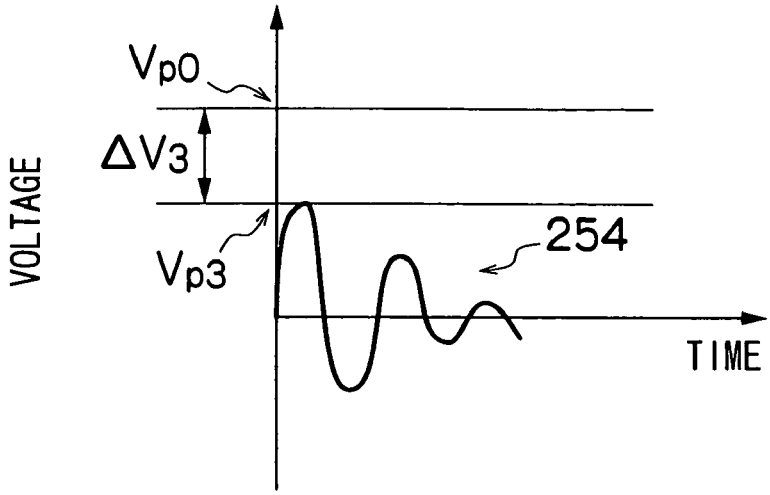
FIGS. 13A to 13C are diagrams for describing a sensor signal and a pulse signal in a case where a medium-size air bubble has occurred.
Figure 13B:
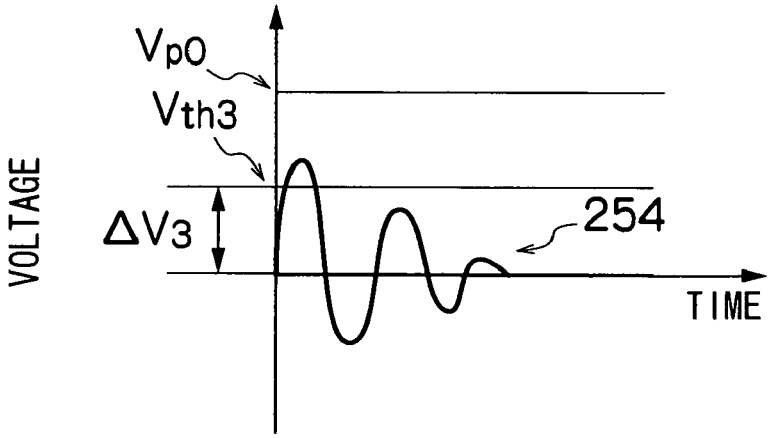

FIG. 13A is a diagram showing a sensor signal 254 in the state where a medium-size air bubble has occurred inside a pressure chamber 52 (see FIG. 10; a signal obtained from the output part 208B of the charge amplifier 208 in FIG. 8). The sensor signal 254 shown in FIG. 13A has the peak value $V_{p3}$ which is smaller than the reference peak value $V_{p0}$ and even smaller than the peak value $V_{p2}$ of the sensor signal 252 shown in FIG. 12A, and as shown in FIG. 12B, a new threshold value $V_{th3}$ ($=V_{th0}+\Delta V_3$) which is derived by adding $\Delta V_3$ ($=V_{p0}-V_{p3}$) to the reference threshold value $V_{th0}$ is obtained from the output part 222A of the threshold value changing circuit 222 in FIG. 8.

Figure 13C:
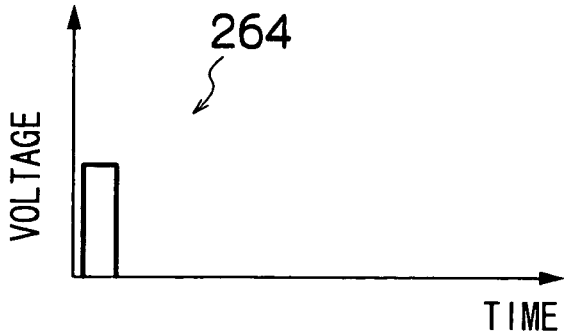

The threshold value $V_{th3}$, which is obtained by changing the reference threshold value $V_{th0}$ (i.e., is obtained by updating the reference threshold value) in this way, and the sensor signal 254 are compared by the comparing circuit 224 in FIG. 8, and thus a pulse signal 264 having one square wave is obtained from the output part 224A of the comparing circuit 224, as shown in FIG. 13C.

Figure 14A:
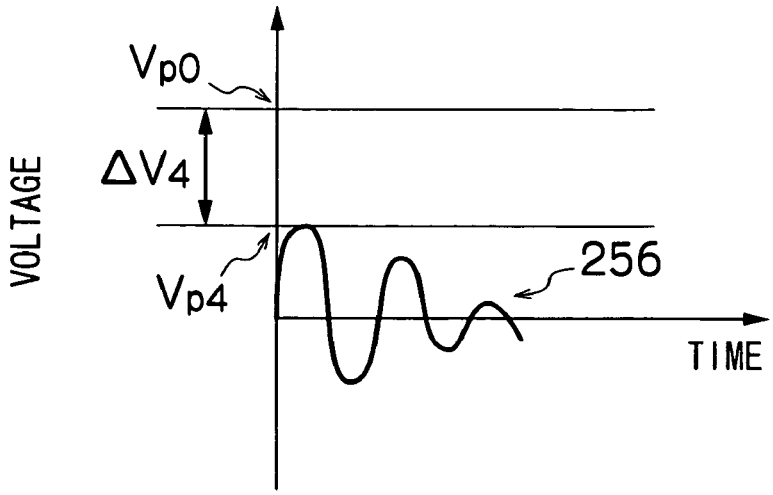
FIGS. 14A to 14C are diagrams for describing a sensor signal and a pulse signal in a case where a large-size air bubble has occurred.
Figure 14B:
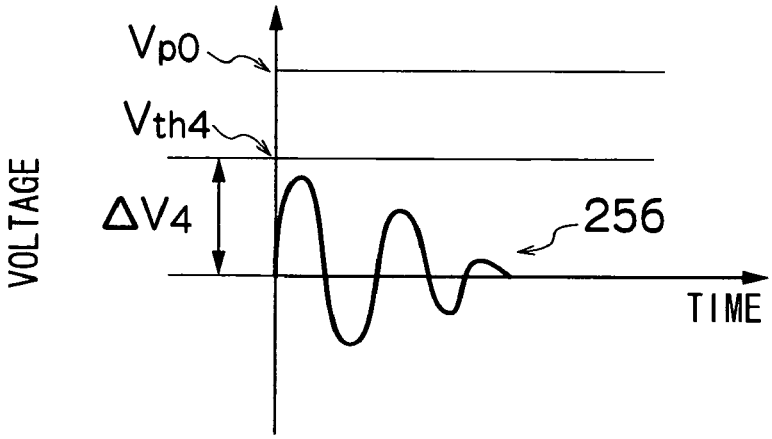

FIG. 14A is a diagram showing a sensor signal 256 in the state where a large-size air bubble has occurred inside a pressure chamber 52 (see FIG. 10; a signal obtained from the output part 208B of the charge amplifier 208 in FIG. 8). The sensor signal 256 shown in FIG. 14A has the peak value $V_{p4}$ which is smaller than the reference peak value $V_{p0}$ and even smaller than the peak value $V_{p3}$ of the sensor signal 254 shown in FIG. 13A, and as shown in FIG. 14B, the new threshold value $V_{th4}$ ($=V_{th0}+\Delta V_3$) which is derived by adding $\Delta V_4$ ($=V_{po}-V_{p4}$) to the reference threshold value $V_{th0}$ is obtained from the output part 222A of the threshold value changing circuit 222 in FIG. 8.

Figure 14C:
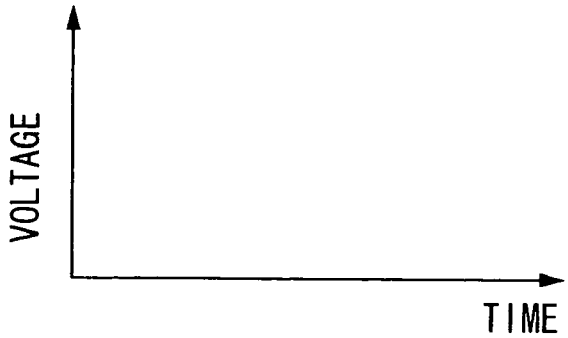

The threshold value $V_{th4}$, which is obtained by changing the reference threshold value $V_{th0}$ (i.e., is obtained by updating the reference threshold value) in this way, and the sensor signal 256 are compared by the comparing circuit 224 in FIG. 8, and thus no pulse signal is obtained from the output part 224A of the comparing circuit 224, as shown in FIG. 14C.

Thus, the threshold value for judging the air bubble size is changed in accordance with the peak value of each sensor signal, and pulse signals having different numbers of pulses are obtained by comparing each sensor signal with the threshold value which is changed (updated). The size of an air bubble occurring inside a pressure chamber 52 is judged on the basis of the pulse signal that is obtained in the aforementioned way.

The sensors 59 used in the inkjet recording apparatus 10 have a sensitivity (electrostatic capacitance) which varies with the operating environment of the head 50, such as the temperature or humidity. In other words, since a sensor signal (reference numeral 240 in FIG. 9A) obtained from a sensor 59 varies with the operating conditions of the head 50, then its peak value (the peak value $V_p$ of the amplified sensor signal 242 in FIG. 9B) also changes.

In the inkjet recording apparatus 10 of the present embodiment, in order to cope with change in a sensor signal occurring as a result of environmental factors of this kind, a composition is adopted in which the threshold value used for judging the air bubble size is changed at each ejection operation, on the basis of the peak value $V_p$ of a sensor signal.

Figure 15:
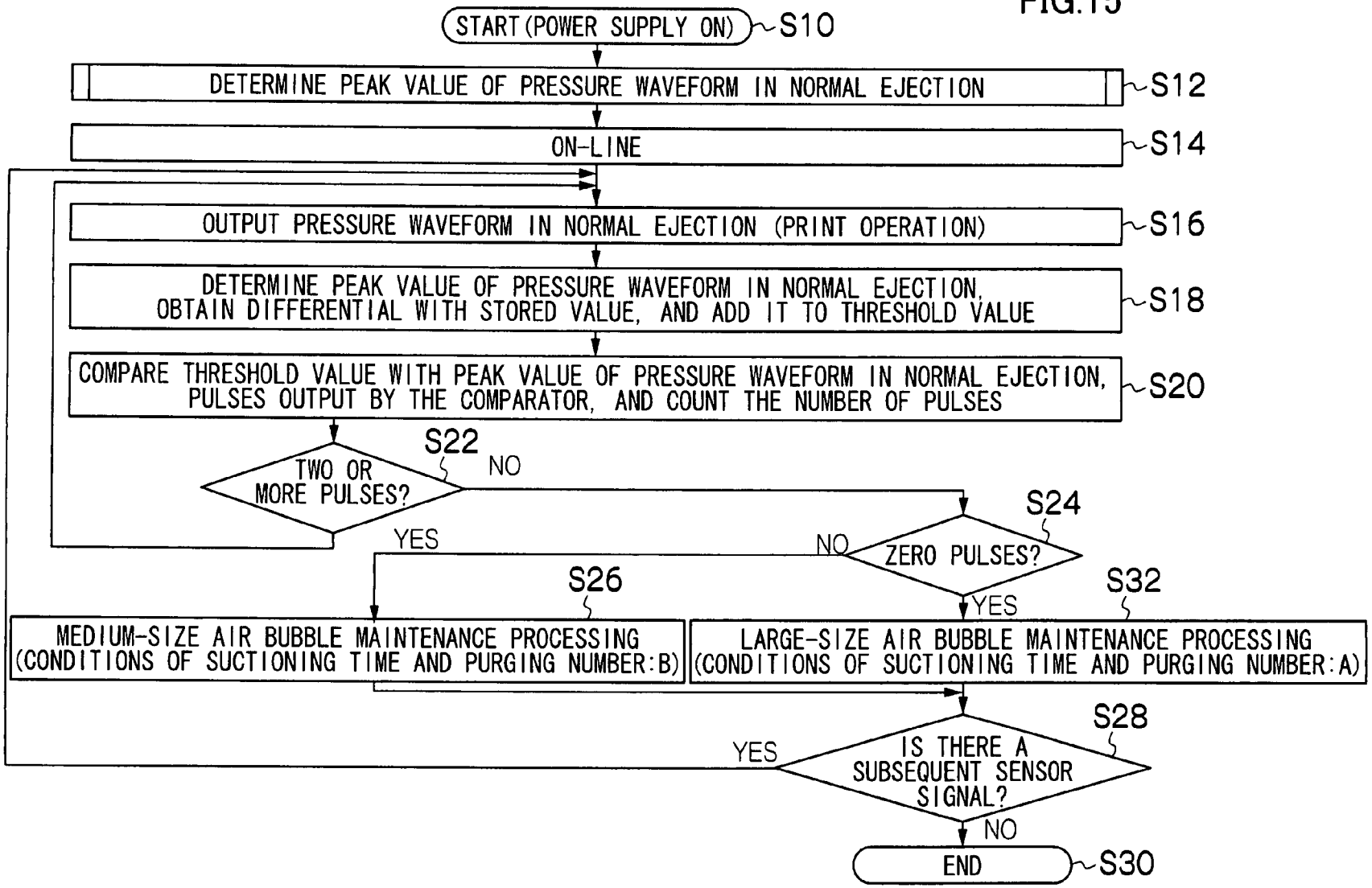
FIG. 15 is a flowchart showing a control sequence for ejection abnormality determination according to an embodiment of the present invention.
Figure 16:
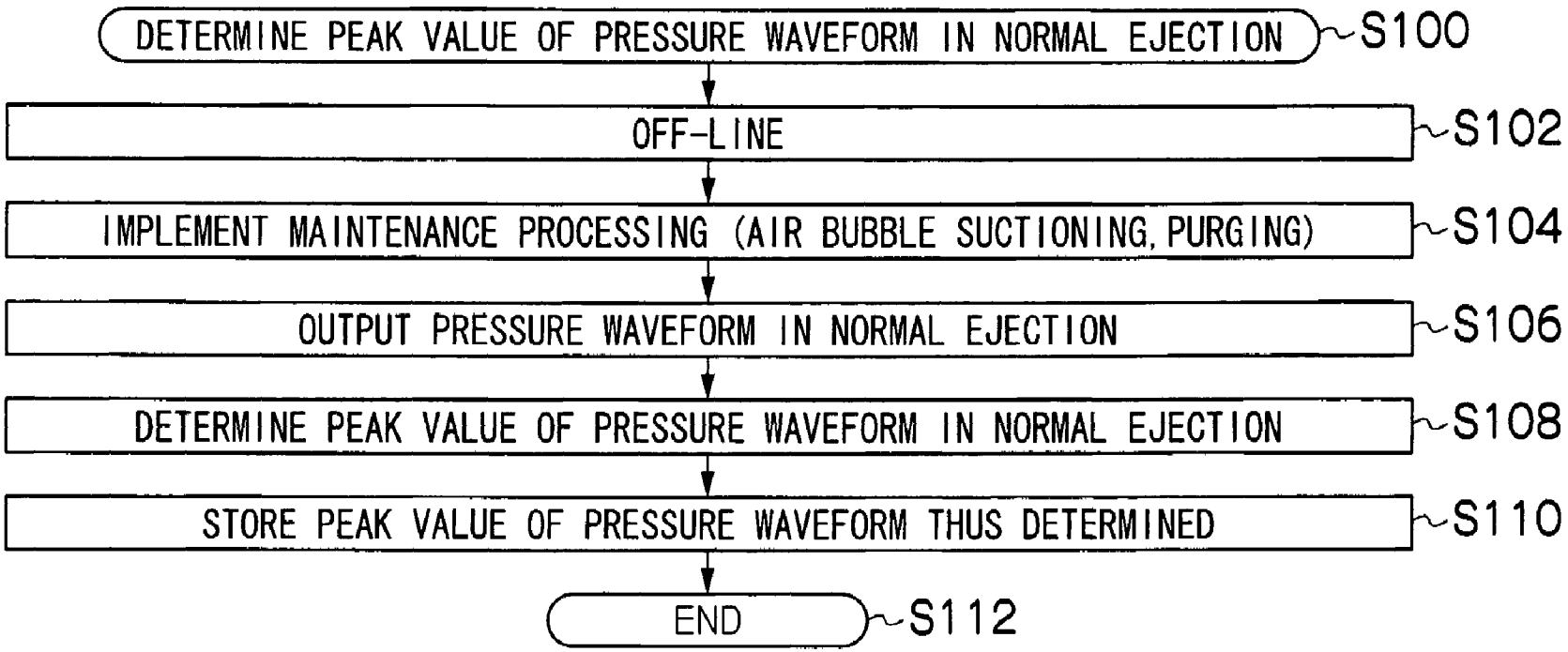
FIG. 16 is a flowchart showing a control sequence for the reference peak value determination shown in FIG. 15.
Figure 17A:
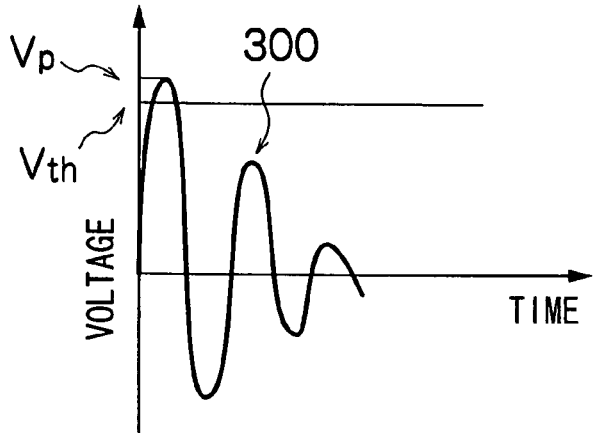
FIG.17A RELATED ART
FIGS. 17A to 17D are diagrams for describing ejection abnormality determination according to the related art.
Figure 17B:
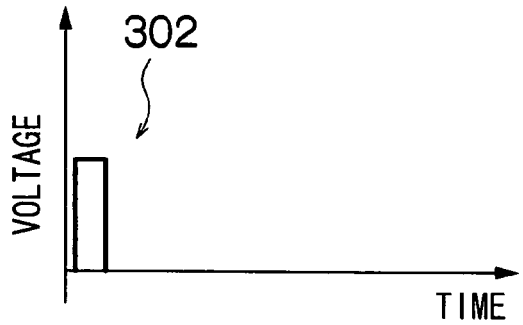
FIG.17B RELATED ART
Figure 17C:
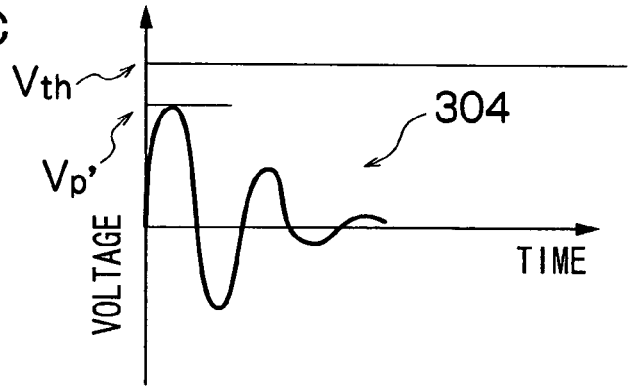
FIG.17C RELATED ART
Figure 17D:
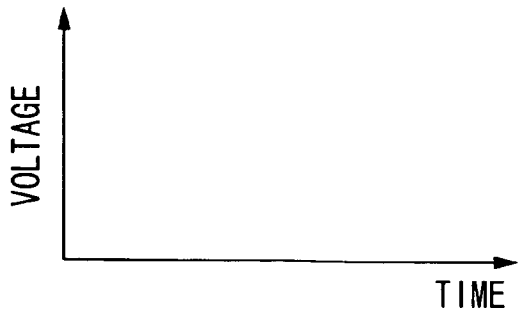
FIG.17D RELATED ART

FIGS. 15 and 16 are flowcharts showing a sequence, used in the inkjet recording apparatus 10, for controlling the judgment of the ejection abnormality. In the ejection abnormality judgment control according to the present embodiment, the reference peak value $V_{p0}$ is derived in the state where no air bubble is present immediately after carrying out the restoration processing (initialization) while the apparatus is off-line (in a non-printing state), and is stored in the memory 216 shown in FIG. 8.

When the apparatus is on-line state (in a printing state), the differential $\Delta V$ between the reference peak value $V_{p0}$ and the peak value of a sensor signal obtained at each ejection operation is derived, and then the size of an air bubble is judged on the basis of a new threshold value which is obtained by adding this differential $\Delta V$ to the reference threshold value $V_{th0}$.

In other words, when the power supply is turned on (step S10), first, the peak value (reference peak value $V_{p0}$) of the pressure waveform in the normal ejection is determined (step S12). FIG. 16 shows a flowchart of the control sequence for calculating the reference peak value $V_{p0}$ shown in step S12.

As shown in FIG. 16, when the reference peak value calculation control sequence starts (step S100), the apparatus enters an off-line state (step S102), and a restoration process is carried out (step S104).

Subsequently, the switch 226 shown in FIG. 8 is switched on (the peak value determination circuit 210 and the A/D converter 214 are connected), the switch 228 is switched off (the D/A converter 220 and the threshold value changing circuit 222 are disconnected), and when a piezoelectric actuator 58 (see FIG. 4) is operated and a pressure waveform is output from the corresponding sensor 59 (step S106), then the peak value of the sensor signal (which becomes the reference peak value $V_{p0}$) is determined (step S108). The reference peak value $V_{p0}$ is stored in the memory 216 shown in FIG. 8 (step S110).

The steps from S100 to S110 are carried out for each nozzle 51, and when the reference peak values $V_{p0}$ for the respective nozzles have been stored, then the reference peak value calculation control sequence terminates (step S112), and the procedure advances to step S14 in FIG. 15.

At step S14, the apparatus enters an online state and a standby state where it waits print data. The switch 226 shown in FIG. 8 is turned off (the peak value determination circuit 210 and the A/D converter 214 are disconnected), and the switch 228 is turned on (the D/A conversion circuit 220 and the threshold value changing circuit 222 are connected).

When a printing operation is carried out by acquiring print data (in a normal ejection state), then piezoelectric actuators 58 are operated and a pressure waveform is output from each sensor 59 (step S16). When the pressure waveform is output from each sensor 59 at step S16, then the peak value $V_p$ of the sensor signal for each nozzle is determined at each ejection operation. In the threshold value changing circuit 222 in FIG. 8, the differential $\Delta V$ between the peak value $V_p$ and the reference peak value $V_{p0}$ is calculated, and the threshold value $V_{thi}$ corresponding to each ejection operation is derived by adding this differential ΔV to the predetermined reference threshold value $V_{th0}$ (step S18 in FIG. 15).

When the threshold value $V_{thi}$ is compared with the sensor signal obtained for each ejection operation in the comparing circuit 224 in FIG. 8, the pulse signal corresponding to the comparison result is output from the output part 224A of the comparing circuit 224 (step S20).

The number of the square waves (pulses) of the pulse signal obtained from the comparing circuit 224 is counted up, and it is judged whether or not the pulse signal contains two or more pulses (step S22). If the pulse signal contains only one pulse or less ("NO" verdict), then the procedure advances to step S24, and it is judged whether or not the pulse signal contains a pulse.

If it is judged at step S24 that the pulse signal contains one pulse ("NO" verdict), then the procedure advances to step S26. If the pulse signal contains two pulses, then it is judged that the medium-size air bubble is present, and the maintenance processing (air bubble removal processing) corresponding to the medium-size air bubble is carried out.

Thereupon, the procedure advances to step S28 where it is judged whether a subsequent sensor signal has been obtained or not, and if the subsequent sensor signal has not been obtained ("NO" verdict), then the current pressure abnormality judgment control sequence is terminated. On the other hand, if the subsequent sensor signal has been obtained ("YES" verdict), then the procedure returns to step S16.

Furthermore, if it is determined that the pulse signal contains no pulse at step S24 ("YES" verdict), then it is judged that the large-size air bubble is present and the maintenance process (air bubble removal processing) corresponding to the large-size air bubble is carried out (step S32), whereupon the procedure advances to step S28.

At step S22, if it is determined that the pulse signal contains two or more pulses ("YES" verdict), then it is judged that the pressure in the pressure chamber 52 is in the normal state (or that it contains the small-size air bubble which is not sufficient to affect ejection), and the procedure then advances to step S16.

If the operating environment of the head 50 is changed, then the determination control sequence for the reference peak value shown in FIG. 16 is carried out, and the memory 216 in FIG. 8 is rewritten. Examples of such a case where operating environment of the head 50 is changed include the following cases: a case where conditions of the circumstances, such as temperature and humidity, have moved outside a prescribed range; and a case where the type of ink used has changed (a case where the ink has been refilled).

In the maintenance processing corresponding to the large-size air bubble and the maintenance processing corresponding to the medium-size air bubble, purging times are set in accordance with the size of the air bubble. More specifically, in a case where the air bubble of a large size is removed, the purging time is set to a longer time than in a case where the medium-size air bubble is removed. By controlling and altering the maintenance times in accordance with the size of the air bubble in this way, it is possible to shorten the required maintenance time in comparison with maintenance control carried out simply on the basis of time management or print intervals as in the related art.

The inkjet recording apparatus 10 having the composition described above has a composition in which the threshold value used for judging the size of an air bubble present in a pressure chamber 52 is changed from the reference threshold value $V_{th0}$ in accordance with the sensor signal obtained from the sensor 59, and the air bubble size is judged on the basis of this threshold value $V_{thi}$ which has been changed (updated). Therefore, even if a small-size air bubble which is not sufficient to affect the ejection has occurred, it is not judged that the ejection abnormality has occurred. Therefore, by means of a simple circuit composition, the size of air bubbles present in the pressure chambers are determined, and it is judged whether an ejection abnormality is present or absent on the basis of the determined air bubble size. Consequently, wasteful and unnecessary maintenance processing is not carried out, the ink consumption is suppressed, and the load of maintenance processing is reduced. Since the threshold value is changed for each nozzle and each ejection operation, it is possible to deal with variations between the sensors and changes in the environment, and the air bubble size is determined in real time.

In the foregoing embodiments, the inkjet recording apparatus using the page-wide full line type head having a nozzle row of a length corresponding to the entire width of the recording paper 16 is described, but the scope of application of the present invention is not limited to this. The present invention may also be applied to an inkjet recording apparatus using a shuttle head which performs image recording while moving the recording head of short dimensions in a reciprocal fashion.

The embodiments described above relate to the inkjet recording apparatus 10 for forming images on the recording paper 16 by ejecting ink from nozzles provided in the head, but the scope of application of the present invention is not limited to those. The present invention may also be applied broadly to image forming apparatuses which each form an image (a three-dimensional shape) by means of a liquid other than ink, such as resist, and to liquid ejection apparatuses, such as a dispenser, which eject liquid chemicals, water, or the like, from a nozzle (ejection hole).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head including a nozzle which ejects liquid, a pressure chamber provided to correspond to the nozzle, a pressure generating element which is disposed on a first wall surface of the pressure chamber and adjusts pressure in the pressure chamber, and a determination element which is disposed on a second wall surface of the pressure chamber and generates a first determination signal corresponding to the pressure in the pressure chamber adjusted by the pressure generating element;

a threshold value setting device which sets a threshold value in accordance with a waveform of the first determination signal generated by the determination element;

a comparing device which acquires a comparison result obtained by comparing the first determination signal with the threshold value which is set by the threshold value setting device; and an evaluation device which acquires an evaluation result obtained by evaluating a size of an air bubble present in the pressure chamber according to the comparison result acquired by the comparing device.

2. The liquid ejection apparatus as defined in claim 1, further comprising:

an air bubble removal device which carries out an air bubble removal processing with respect to the liquid ejection head; and a control device which controls the air bubble removal device according to the evaluation result acquired by the evaluation device.

3. The liquid ejection apparatus as defined in claim 2, wherein the control device controls the air bubble removal device in such a manner that, when the size of the air bubble present in the pressure chamber evaluated by the evaluation device is sufficient to cause an ejection abnormality, the air bubble removal processing is carried out with respect to the liquid ejection head.

4. The liquid ejection apparatus as defined in claim 1, wherein the threshold value setting device sets the threshold value according to a maximum value of the first determination signal generated by the determination element.

5. The liquid ejection apparatus as defined in claim 4, further comprising a reference maximum value storage device which stores the maximum value of the first determination signal as a reference maximum value, wherein the determination element further generates a second determination signal corresponding to the pressure in the pressure chamber; and the threshold value setting device sets the threshold value to a differential value between the reference maximum value stored in the reference maximum value storage device, and a maximum value of the second determination signal generated by the determination element.

6. The liquid ejection apparatus as defined in claim 1, wherein the liquid ejection head includes a plurality of the nozzles, a plurality of the pressure chambers corresponding to the nozzles, and a plurality of the determination elements corresponding to the pressure chambers; and the threshold value setting device sets the threshold value for each of the pressure chambers.

7. An air bubble determination method for a liquid ejection head including a nozzle which ejects liquid, a pressure chamber provided to correspond to the nozzle, a pressure generating element which is disposed on a first wall surface of the pressure chamber and adjusts pressure in the pressure chamber, and a determination element which is disposed on a second wall surface of the pressure chamber and generates a determination signal corresponding to the pressure in the pressure chamber adjusted by the pressure generating element, the air bubble determination method comprising the steps of:

adjusting the pressure in the pressure chamber by driving the pressure generating element;

acquiring the determination signal generated by the determination element when the pressure in the pressure chamber is adjusted by the pressure generating element;

setting a threshold value according to the determination signal generated by the determination element;

acquiring a comparison result obtained by comparing the determination signal with the threshold value; and acquiring an evaluation result obtained by evaluating a size of an air bubble present in the pressure chamber according to the comparison result.

8. The air bubble determination method as defined in claim 7, further comprising the step of implementing an air bubble removal processing with respect to the liquid ejection head according to the evaluation result.

9. The air bubble determination method as defined in claim 7, wherein the threshold value is set, each time the pressure in the pressure chamber is adjusted by driving the pressure generating element;

the comparison result is acquired by comparing the threshold value with the determination signal generated by the determination element, each time the pressure in the pressure chamber is adjusted by driving the pressure generating element; and the evaluation result is acquired by evaluating the size of the air bubble present in the pressure chamber, each time the pressure in the pressure chamber is adjusted by driving the pressure generating element.

10. The air bubble determination method as defined in claim 7, further comprising the steps of:

performing a restoration processing with respect to the liquid ejection head; and storing a maximum value of the determination signal as a reference maximum value, the determination signal being generated by the determination element when the pressure in the pressure chamber is adjusted by the pressure generating element immediately after the restoration processing is performed.

* * * * *